United States Patent [19]

Buckwitz et al.

[11] Patent Number: 5,063,974

[45] Date of Patent: Nov. 12, 1991

[54] AUTOMATIC WIRE CUT, COIL, AND TIE SYSTEM

[75] Inventors: Richard J. Buckwitz, Issaquah; Donald W. Spencer, Snohomish, both of Wash.

[73] Assignee: The Boeing Company, Seattle, Wash.

[21] Appl. No.: 596,985

[22] Filed: Oct. 11, 1990

[51] Int. Cl.[5] ..... B21F 3/04

[52] U.S. Cl. ..... 140/92.2; 29/605; 242/25 R

[58] Field of Search ..... 140/92.2; 29/605, 755; 242/7.08, 7.09, 25 R, 25 A, 110, 110.1

[56] References Cited

U.S. PATENT DOCUMENTS

| | | | |
|---|---|---|---|
| Re. 29,214 | 5/1977 | Schultz | 174/72 R |
| 3,105,653 | 10/1963 | Beckwith | 242/110.1 |
| 3,108,922 | 10/1963 | Possis et al. | 140/92.2 |
| 3,792,190 | 2/1974 | Schultz | 174/72 R |
| 3,842,496 | 10/1974 | Mercer | 29/624 |
| 3,902,679 | 9/1975 | Bost | 242/129 |
| 4,022,396 | 5/1977 | Manchester et al. | 242/55.17 |
| 4,695,001 | 9/1987 | Dreher et al. | 242/25 R |
| 4,715,100 | 12/1987 | Cross | 29/755 |
| 4,809,917 | 3/1989 | Tsuchiya | 29/605 |

FOREIGN PATENT DOCUMENTS

| | | |
|---|---|---|
| 762800 | 3/1953 | Fed. Rep. of Germany . |
| 597877 | 2/1948 | United Kingdom . |
| 1149001 | 4/1969 | United Kingdom . |

*Primary Examiner*—Lowell A. Larson

*Attorney, Agent, or Firm*—Christensen, O'Connor, Johnson & Kindness

[57] ABSTRACT

A system for automatically coiling, cutting, and tying wires. The system (50) includes a plurality of wire reels (52) from which a measured length of a selected wire (114) is coiled at a coiling assembly (60). Each of the plurality of wires (54) are arranged in spaced-apart planar array across a wire select assembly (56). A control (82) selects one of the wires for coiling based upon a programmed work schedule. The end selected wire is drawn from a sensor assembly (88) on the wire select assembly by a wire feed assembly (58) and transferred to the coiling assembly. The coiling assembly winds the selected wire into a coil (402), at either a seven- or ten-inch (inside) diameter. Pinch marks previously applied to the wire or a length sensor (122) determine when a required length of the wire has been coiled. The coiled wire is then lifted from the coiling assembly by a pick and place assembly (66) and moved to one of two wire tying machines (61/62), where a tie is applied to the coiled wire so that it can be stacked on a pallet (400). A conveyor (70) conveys the pallets to an operator workstation (72) where the coiled wires are assembled into wire groups needed to make wire bundles.

35 Claims, 20 Drawing Sheets

200
196
198
200
211
212
212
210
206
212
208
192
210
212
218
214
204
216
140
144
146
142
54
152
148

Fig. 19.
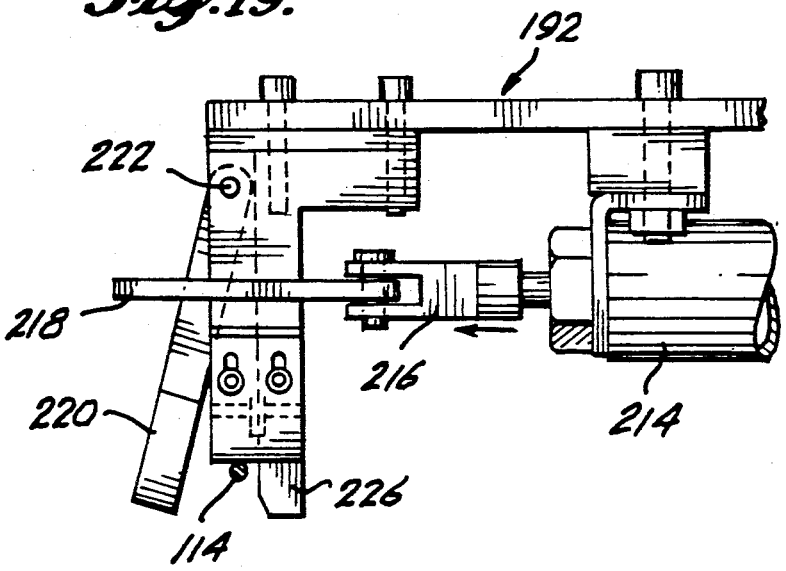
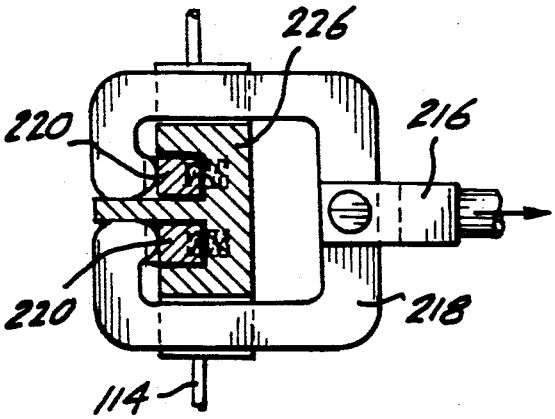
Fig. 19A.
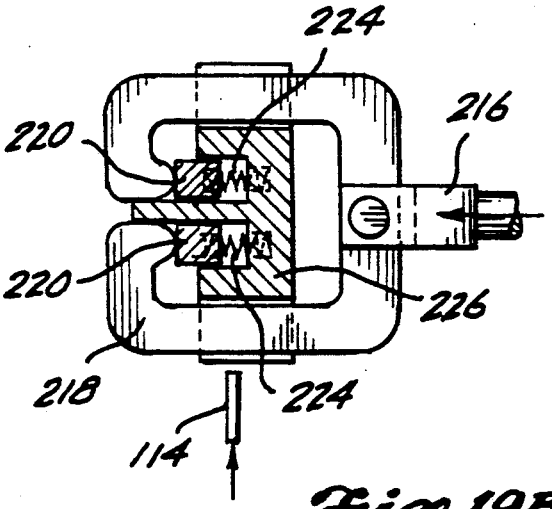
Fig. 19B.

Fig. 22.
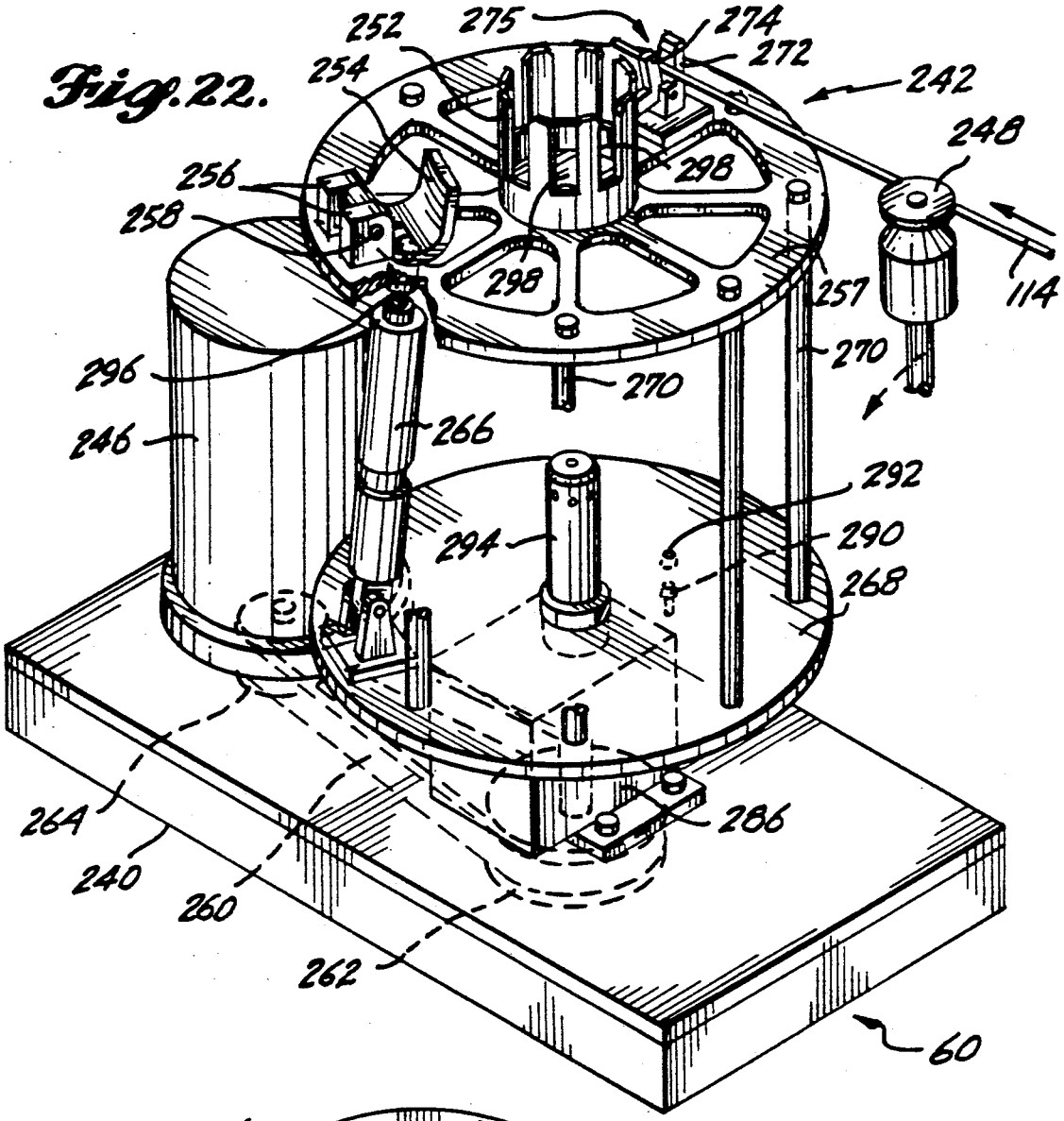
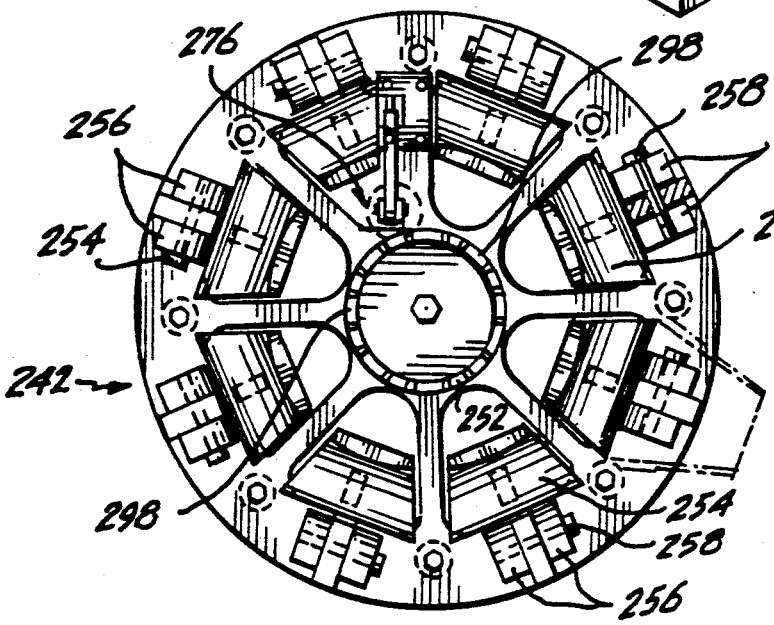
Fig. 21.

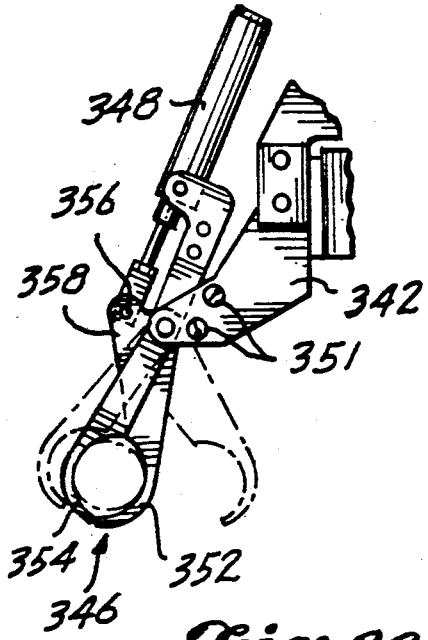
Fig. 28B.
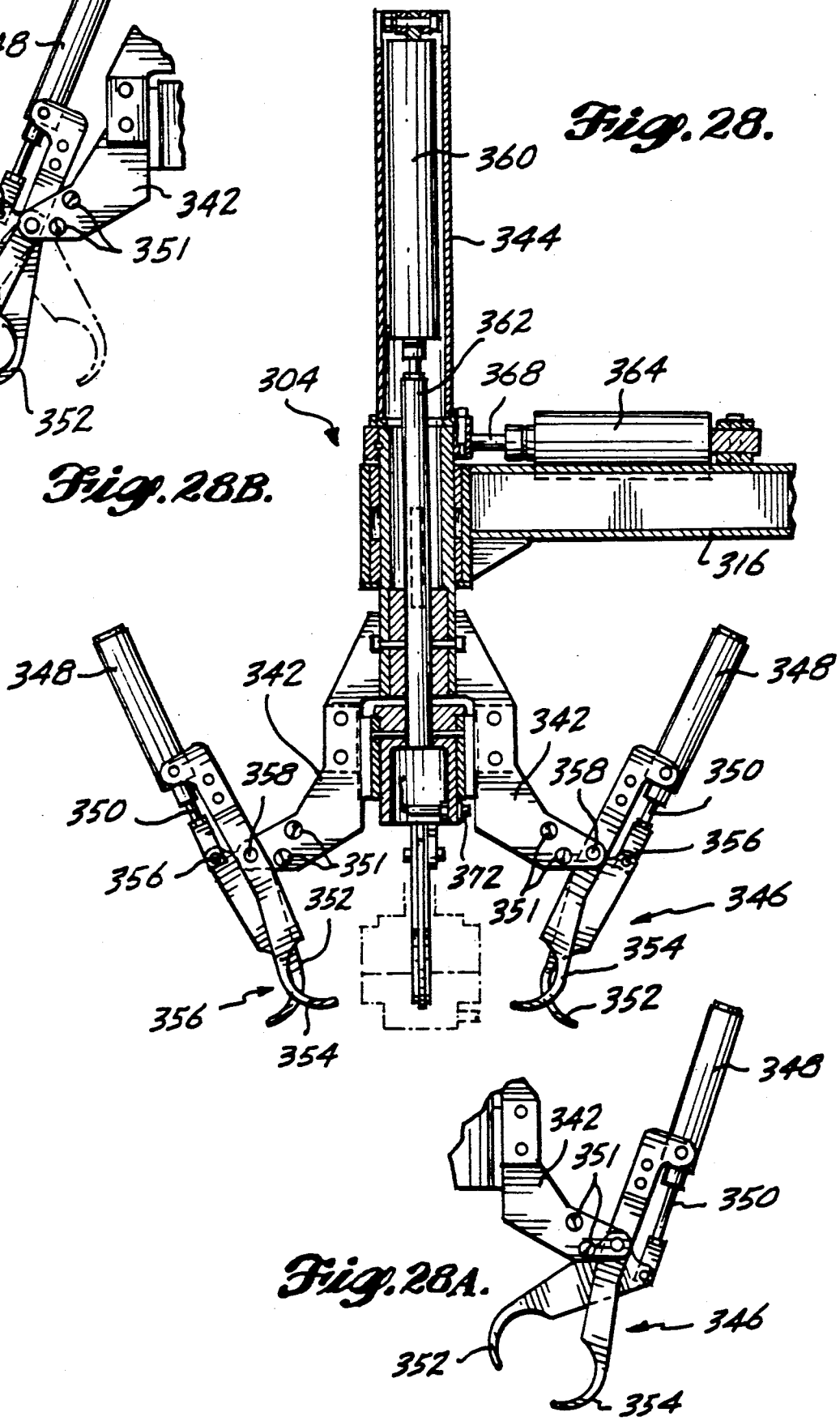
Fig. 28.
Fig. 28A.

AUTOMATIC WIRE CUT, COIL, AND TIE SYSTEM

FIELD OF INVENTION

The present invention relates to a system for cutting wires that are to be formed into multi-wire bundles or harnesses.

BACKGOUND OF THE INVENTION

A modern jet aircraft typically includes several hundred multi-wire bundles for electrically connecting various aircraft subsystems. Such bundles can conveniently be broken down into two types: integration bundles that are comparatively short but that include a large number of individual wires and typically, also include a large number of branch points, and ships bundles that typically comprise a small number of long wires with few branches.

Under current technology, different manufacturing methods are generally used for integration and ships bundles. The first step in building an integration bundle is to pass raw wire through a coding machine such as a Conrac. The Conrac machine operates under the control of a computer in response to information in a database specifying the lengths and code numbers of the individual wires required for a given bundle. Coding is accomplished by a hot stamp process in which identifying alphanumeric code symbols (e.g., letters and/or numbers) are printed on the wire insulation signifying the unique part number of each piece of wire. The computer controlling the Conrac machine instructs the operator concerning the type of raw wire spool to be mounted on the input spindle. After the wire spool is mounted, the machine unreels, codes, and places pinch marks on the wire at predefined intervals along its length, then winds the coded and pinch-marked wire on an output reel.

The reels of coded and pinch-marked wire that will be incorporated into integration bundles are presently processed using a computer-aided, hand-forming (CAHF) process. In a CAHF process, a form board is created for each bundle design. The form board includes a planar baseboard, a drawing attached to the baseboard with imprinted instructions and diagrams relating to wire routing, and pegs projecting above the baseboard around which wire can be routed or to which wire can be tied off.

In recent years, ink-jet coding machines have become available that are capable of applying codes to wire while the wire is moving rapidly through the machine at speeds up to 350 feet per minute. Ink-jet machines therefore make possible efficient reel-to-reel wire coding in which a reel of wire is continuously unrolled from an input spool, coded in the ink-jet machine, and rewound onto an output reel. The ink-jet machine identifies the beginning and end of each wire segment with a double ink-jet block mark. The small space within each double ink-jet block mark is the end of the segment. A pinch-mark applicator device is available to apply pinch marks at the double block mark during the continuous coding operation. Unless multiple segments of the same wire are being coded, the code applied to each wire segment changes with each double block mark. Once marked, pinched and re-reeled, the wire is transported to the CAHF wire forming area. Although the ink-jet coding machine can operate much faster while producing continuous filament wire, usage of the ink-jet for coding cut wire segments typically limits the output speed to about 35 feet/minute.

At the CAHF wire forming area, an operator uses the pinch-marked and ink-jet or Conrac coded wire to form integration bundles. In response to instructions on a computer monitor, the CAHF operator unreels coded and pinch-marked wires from the reels and winds these wires on the form board, using the codes and pinch marks to verify correct placement. The wire is cut on both sides of the pinch marks after it has been placed on the form board.

In contrast to the semi-automated process for building integration bundles, under present technology, ships bundles are typically created by a conventional manual lay-down process that uses individual wires. In this process, a Conrac machine is used to code and cut individual wires (cutting the wire to predefined lengths instead of merely pinch marking it). For efficiency, an operator loads a given wire reel on the input spindle of the Conrac machine, and then codes and cuts off wire segments that are required from that reel. After each wire segment is coded and cut, the operator manually coils the wire and places it with other wires corresponding to a given wire group within a bundle. The Conrac machine can process wires for a number of bundles at a given time. Every bundle that is built by the conventional lay-down process is organized as an assembly of one or more wire groups. The bundles are further organized in respect to certain connectors that are joined to the wires before form board wire routing (referred to as first end connectors), or connectors joined to the wires after form board wire routing (referred to as second end connectors). Wire groups that provide all the wires to fill a single first end connector are called first end wire groups, and wires that attach only between second end connectors are organized into miscellaneous wire groups.

When the Conrac operator has collected a complete set of wires for a given ships bundle, these wires are then transferred in a bundle tote (a carrying box) to a first end assembly area where a first end connector is applied to the wires at one end of the bundle. The group of wires for a bundle, with the connector on one end, is then laid out on a conventional form board, tied, and trimmed to the length drawn on the form board. The bundle is then removed from the form board, replaced in the tote, and processed through a second end connector assembly area where the second end connectors are applied at the other ends of the wires in the bundle. Assembly of the wires into the groups required for a given ships bundle before assembly expedites the manufacturing process; however, substantial manual labor is required to cut and collate all the wires in the multiple groups, which comprise a bundle.

Clearly, the CAHF process used to form integration wire bundles from a continuous wire filament is faster than the manual process that requires an operator to assemble individual pre-cut wires in groups to form ships bundles. Forming integration wire bundles from a continuous wire filament using a computer-controlled harness maker is also relatively efficient. However, many integration bundles cannot be made from the continuous filament wire process, and thus are formed using manual labor to handle the individual lengths of wire, just as is done in building ships bundles. It will therefore be apparent that an automated system is needed to cut required lengths of wire and collate it into groups for assembly into bundles that can not readily be formed from continuous filament wire.

Accordingly, it is an object of this invention to automate the process of cutting wire to required lengths and assembling the wires into groups used to make bundles. A further object is to provide apparatus capable of cutting wire to lengths defined by pinch marks previously applied to the wire, and of coiling and typing the lengths of wire in their coiled configuration. A still further object is to cut wire that is not coded or pinch marked into predefined lengths, and to coil and tie the wire. Yet a further object is to accumulate on a pallet a plurality of coiled and tied wires that comprise a wire group, which will be used to make a bundle. These and other objects and advantages over the prior art will be apparent from the attached drawings and the Description of the Preferred Embodiment that follows.

SUMMARY OF THE INVENTION

In accordance with the present invention, a system is described for automatically coiling, cutting, and handling one of a plurality of wires. The system includes means for selecting one of the plurality of wires that is to be cut and coiled. Coiling means form the selected wire into at least one coiled loop by winding the wire around a rotatable spindle. Means are provided for sensing the length of the wire as it is wound on the spindle. Control means that are connected to the means for sensing the length of the wire and to the coiling means are operative to stop the coiling means when a predetermined length of the wire has been coiled, at which point, cutting means cut the wire. Tying means are also provided to secure the loops of the wire so that they do not uncoil. Once the wire is coiled into one or more loops on the spindle and cut, pick and place means remove the loops from the spindle, transfer the coiled wire to the tying means, and after the loops are secured, move the wire to a receiving station (where the coiled wire is placed on a pallet).

The means for selecting the wire to be cut and coiled include a movable frame in which the ends of the plurality of wires are spaced apart from each other in an array. Means are also provided for clamping each wire in place until it is selected and advanced toward the coiling means.

Comprising the spindle are a plurality of segments that are pivotally mounted on the coiling means at spaced-apart points around a rotational center. These segments define a surface around which the wire is wound into coiled loops. The coiling means also include means for varying the diameter of the coiled loops by pivoting the segments into one of a plurality of different positions. A clamp is provided on the coiling means for grasping a lead end of the wire as the spindle rotates.

The means for sensing the length of the wire comprise means for detecting where an insulating material covering the wire was pinched to mark a predetermined length; the pinch marks the wire length by perforating the insulating material. The means for detecting a pinch mark comprise a capacitance sensor that detects a difference in capacitance of the wire where the pinch in the insulating material at least partially exposes an electrical conductor within the wire.

For use with wire that is not pinch marked, the means for sensing the length comprise a rotatable wheel that is in contact with the wire and rotates as the wire is advanced and coiled by the coiling means. Rotation of the wheel produces a signal indicative of the length of the wire advanced and coiled, which is input to the control means.

The system further includes means for sensing a splice, which are connected to the control means. The control means reject a length of wire in which a splice is sensed, by causing the length of wire to be discarded by the pick and place means.

The pick and place means include a plurality of pairs of opposed clamping fingers spaced apart from each other and distending radially around a central hub that is movable in at least two directions. This hub is connected to a frame movable between the coiling means, the tying means, and the receiving station. Also included in the pick and place means is a clamp that is disposed on an arm. The arm is pivotally attached to the frame and the clamp is operative to grasp a free end of the wire when the coiled loops are removed from the spindle.

Further comprising the coiling means are means for sensing the rotational position of the spindle. These means for sensing are connected to the control means, which are operative to align the fingers of the pick and place means with slots formed in the spindle after the wire is coiled to facilitate removal of the coiled loops. To align the fingers with the slots, the control means rotate the pick and place means.

A pallet having means for securing the coiled loops of wire and for clamping a free end of the wire moved by the pick and place means is included at the receiving station. Coiled loops of wire that are to be connected in a common group are placed on the pallet at the receiving station. The receiving station includes a conveyor on which the coiled and secured loops are moved as distinct groups of related wires.

BRIEF DESCRIPTION OF THE DRAWINGS

FIG. 19 is an elevational side view of the translational clamp;

FIG. 19A is a cross-sectional view of the translational clamp, showing it closed in order to grip a wire;

FIG. 19B is a cross-sectional view of the translational clamp, showing it open;

FIG. 21 is a plan view of the coiling spindle assembly;

FIG. 22 is an isometric view of the coiling spindle assembly, illustrating only one of a plurality of coil-forming segments (and its associated actuator) that comprise the assembly;

FIG. 28 is a cross-sectional view of a portion of the pick and place assembly;

FIG. 28A illustrates one of the pick and place grippers moving to a closed disposition to grip a small diameter coil of wire;

FIG. 28B illustrates one of the pick and place grippers in a closed position, and in phantom view, shows the gripper in a fully open position;

DESCRIPTION OF THE PREFERRED EMBODIMENT

System Overview

Figure 1:
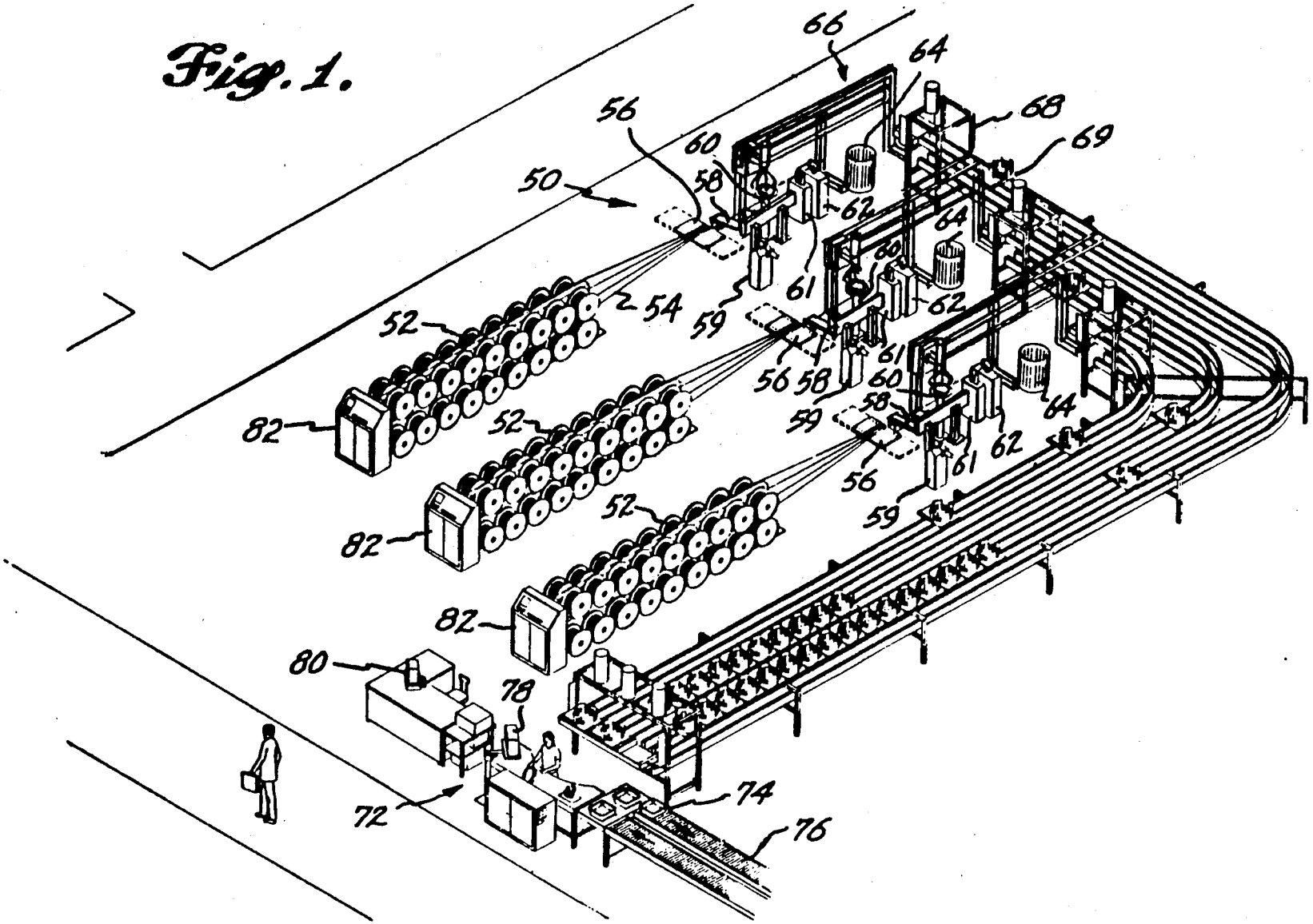
FIG. 1 is an isometric view showing the layout of three automatic wire cut, coil, and tie systems and an associated conveyor for moving pallets on which the tied coils are stacked to an operator workstation.
Figure 2:
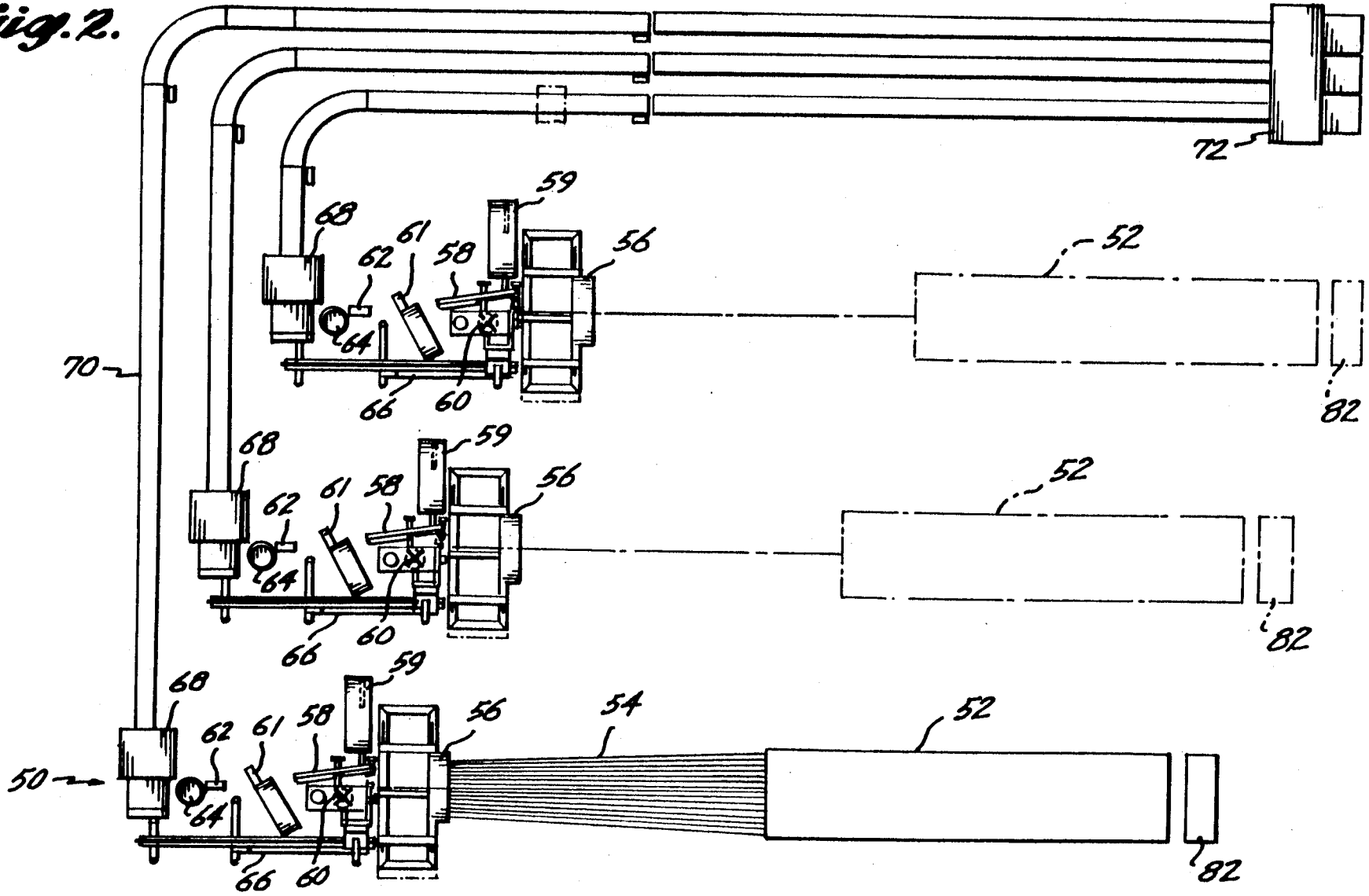
FIG. 2 is a plan view of the layout illustrated in FIG. 1.

An auto cut, coil, and tie system in accordance with the present invention is shown generally at reference numeral 50 in FIGS. 1 and 2. Actually, FIGS. 1 and 2 illustrate the integration of three such systems into a facility for assembling cut, coiled, and tied wires into wire groups that are further assembled into wire bundles. The following comments relate to one of these systems; however, it will be understood that each of the three systems illustrated in FIGS. 1 and 2 are generally similar.

Auto cut, coil, and tie system 50 includes a plurality of wire reels 52, each of which may provide a different type or gauge of wire 54. In the preferred form of the invention, there are 36 wire reels in each system from which a specific wire of a desired type and gage may be selected, and a measured length of the wire coiled, cut, and tied. Wires 54 extend from wire reels 52 to a wire select assembly 56, which moves to bring one of the wires to an appropriate position where a wire feed assembly 58 can advance the wire to a coiling assembly 60. Wire reels 52 include a frictional drag mechanism (not shown) to maintain tension in wires 54 and to prevent the wires from freely unspooling unless specifically drawn from the wire reels.

A programmed length of selected uncoded wire is measured and coiled by coiling assembly 60. During this process, identification labels can optionally be applied to the uncoded wire by a label printer assembly 59. Data on the label is supplied by a control 82. Alternatively, a predefined length of coded wire that extends between pinch marks previously applied to the wire on reels 52 is coiled by coiling assembly 60. Pinch-marked wire is precoded or marked with an ink-jet printer to identify each predefined length. In the preferred embodiment, the inside diameter of the wire coils formed by coiling assembly 60 can be selectively set to either seven inches or ten inches to accommodate coils of various length and wire gauge.

A pick and place assembly 66 grasps a coiled length of the wire after it is cut and conveys it to either a TACKIT-TWISTER TM tying machine 61 or a TIEMATIC TM tying machine 62, depending upon the cross-sectional size of the coil. Alternatively, a heat welded polyester strap applicator can be used in place of tying machines 61 and 62. Tying machine 61 can handle a coil having substantially larger cross section than tying machine 62. The selected tying machine 61 or 62 ties the coil of wire so that it does not uncoil when released by pick and place assembly 66. Thereafter, the pick and place assembly moves the coiled and tied wire to a receiving station 68, where it is placed upon a pallet 69. A waste receptacle 64 is included in each auto cut, coil, and tie system 50 to receive partially completed coils of wire with splices or defects in the insulation that render the wire unusable. In addition, coils of wire that are shorter than the required length (formed from wire that has run out at the end of the reel) are discarded in receptacle 64. After a predetermined number of coils of wire are loaded onto pallet 69, a conveyor 70 moves the pallet to an operator workstation, generally indicated at a reference numeral 72.

At operator workstation 72, the coils are off-loaded manually from pallet 69 and placed in a bundle tote 74 along with coils of wire from other pallets required to make a wire bundle. Bundle totes 74 are subsequently carried to other station (not shown) by a conveyor 76, for connection to appropriate connectors and additional operation required to make completed wire bundles.

A display screen 78 identifies the pallets that include wire for a specific wire group and bundle tote, and informs the operator of the status of the auto cut, coil, and tie operation proceeding on each of three systems comprising the overall facility. Each auto cut, coil, and tie system 50 is controlled by control 82 in accordance with programmed instructions and is responsive to programmed worksheet data that define the selection, coiling, cutting, and delivery of a specific one of wires 54 to pallet 69. A terminal 80 provides access to the program data within control 82, allowing the operator to interrupt the auto cut, coil, and tie process. In addition, terminal 80 alerts the operator if one of the wire reels 52 is empty and requires replacement.

Wire Select Assembly

Figure 3:
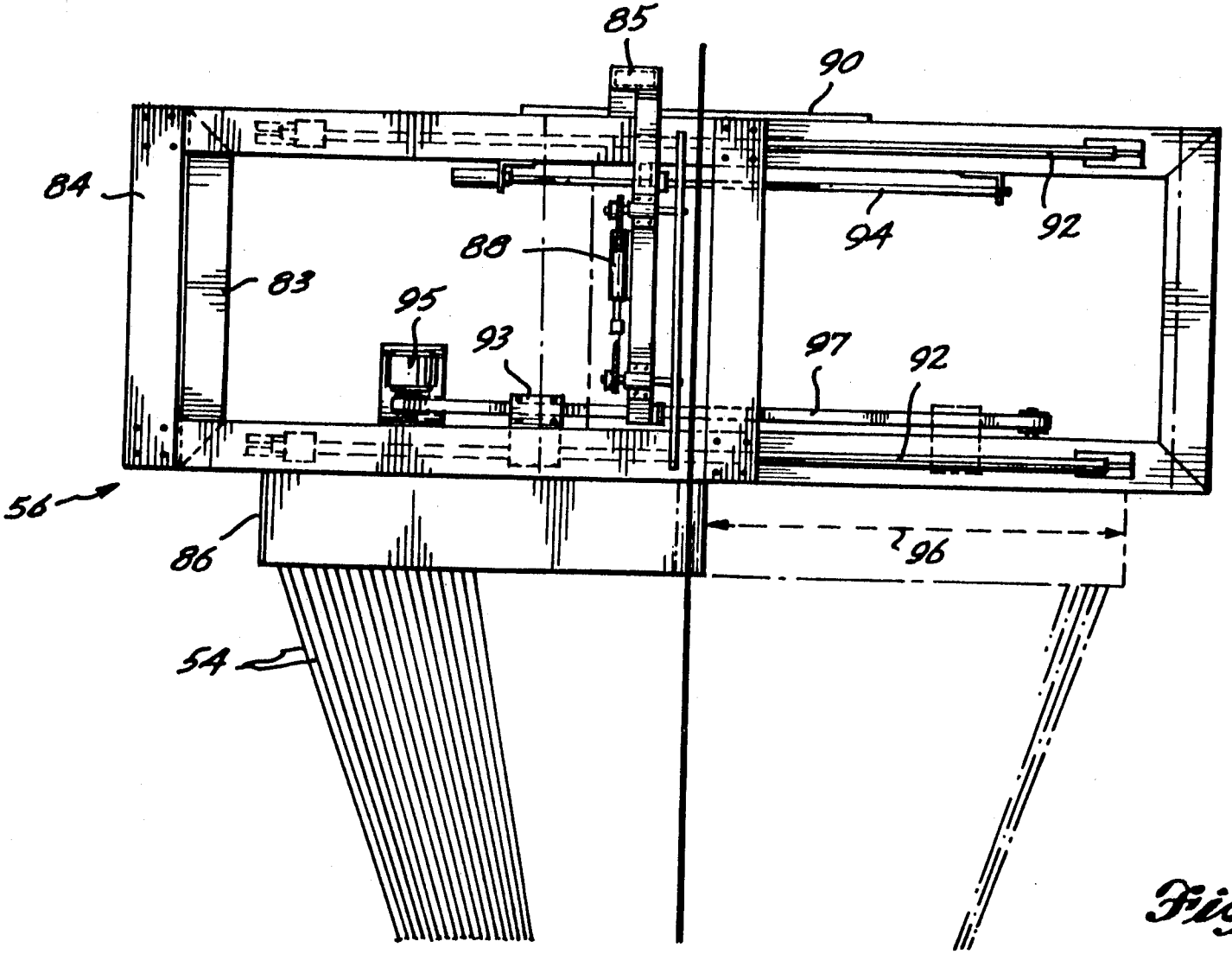
FIG. 3 is a plan view of a wire select shuttle assembly for one of the systems of FIGS. 1 and 2.
Figure 6:
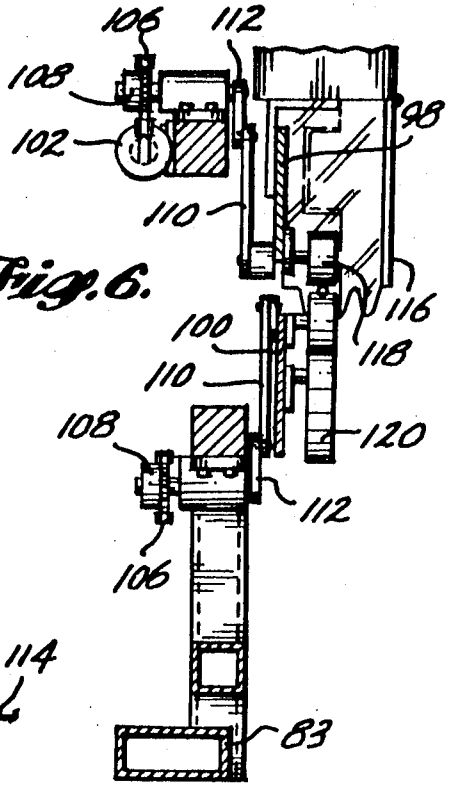
FIG. 6 is an end elevational view of the assembly shown in FIGS. 4 and 5.
Figure 5:
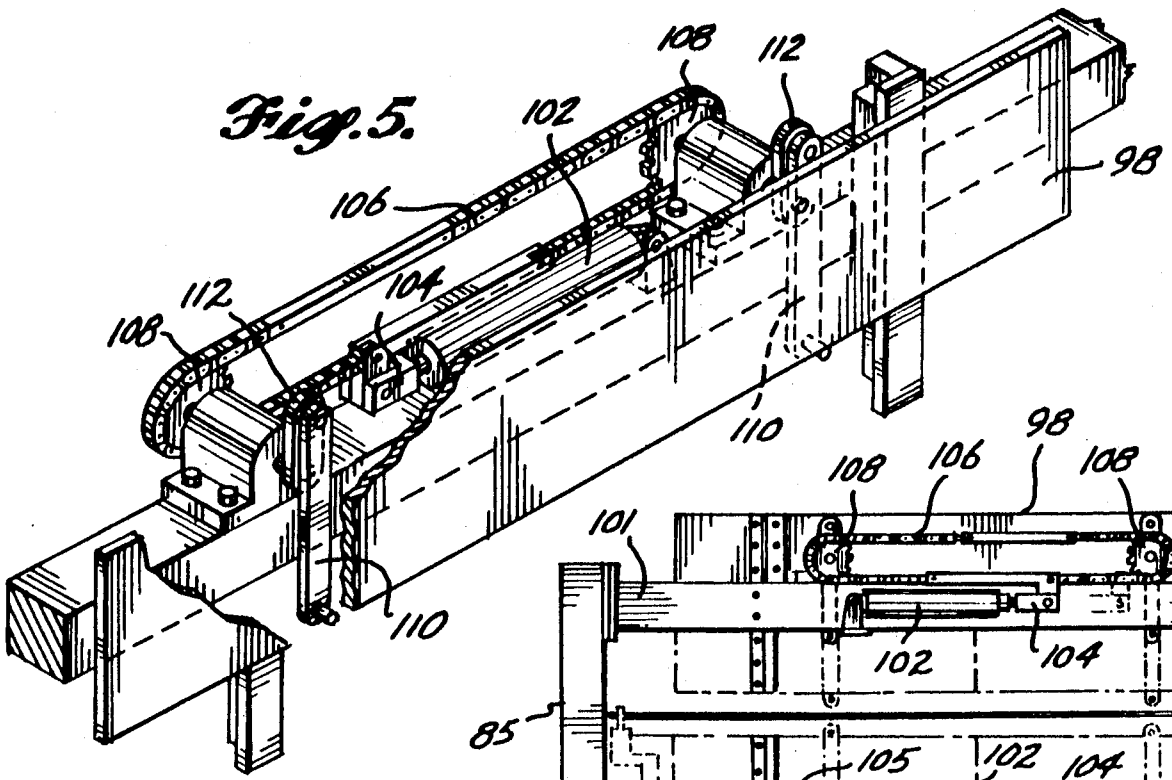
FIG. 5 is an isometric view of a portion of the pinch/-splice detector and wire length measurement assembly, partially cut away to show a Pitman arm that is used to move the assembly vertically.
Figure 4:
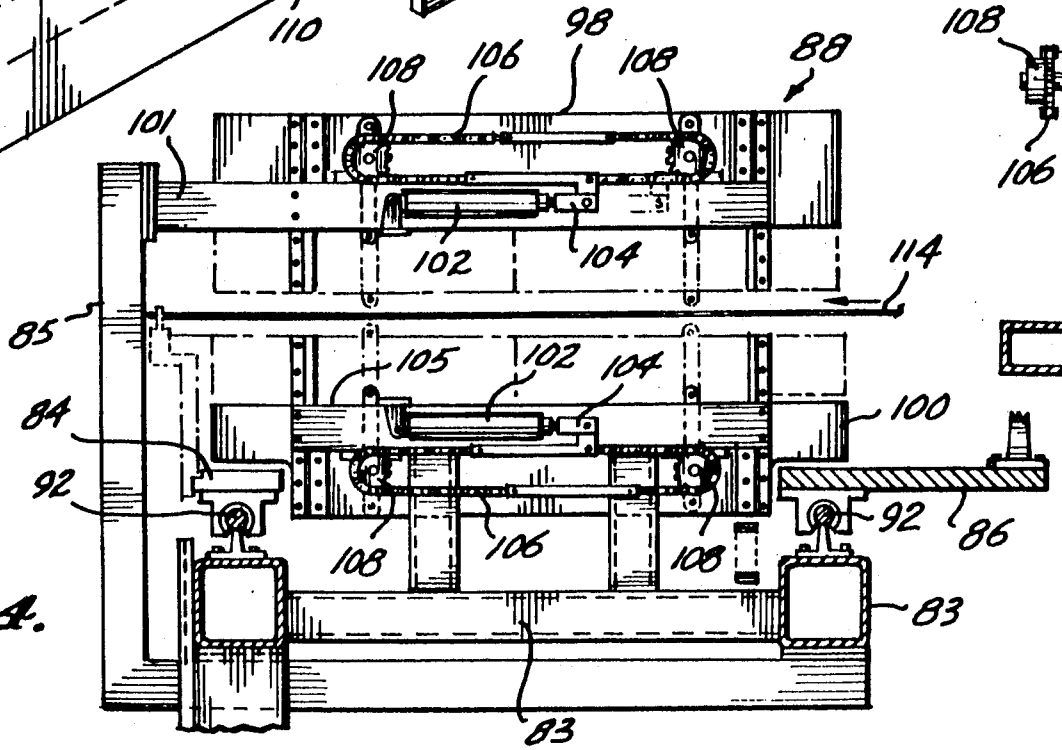
FIG. 4 is an elevational view of a pinch/splice detector and a wire length measurement assembly that comprises a portion of the wire select assembly.

FIGS. 3 through 14 illustrate components of wire select assembly 56. In FIG. 3, the wire select assembly is shown in plan view. The 36 wires 54 enter the wire select assembly in a spaced-apart, horizontal planar array above a wire guide plate 86. Wire select assembly 56 rests on a supporting base 83. Base 83 includes a vertical member 85, which supports a sensor assembly 88. A movable frame 84 to which wire guide plate 86 is attached translates or moves wires 54 longitudinally above base 83, as shown in FIG. 3 by a dashed arrow 96, to position one of the wires at sensor assembly 88. The force required to translate the array of wires is supplied by a motor 95, which drives a belt 97. A bracket 93 is connected between belt 97 and movable frame 84, transmitting the motion of the belt to the movable frame. Movable frame 84 rides upon rails 92, which are fixed to base 83. A linear position sensor 94 provides a feedback signal to control 82, which stops motor 95 when movable frame 84 is properly positioned so that a specific one of wires 54 is aligned with sensor assembly 88.

Details of sensor assembly 88 are shown in FIGS. 4 through 8. Sensor assembly 88 includes a top panel 98 and a bottom panel 100. Since wires 54 must move between the top and bottom panels as the desired wire is positioned in alignment with sensor assembly 88, these panels are mounted to move vertically apart from each other to provide the necessary clearance. Vertical movement of the top and bottom panels apart from each other is accomplished using two pneumatic cylinders 102, which are mounted to base 83 adjacent the panels. Specifically, the pneumatic cylinder 102 that moves top panel 98 is connected to a cross member 101 that extends laterally from vertical member 85. Similarly, the pneumatic cylinder 102 used to move bottom panel 100 is mounted on a cross member 105 of base 83. When actuated by pressurized air, a piston (not shown) in each of pneumatic cylinders 102 laterally moves a drive tang 104. Each of the two drive tangs 104 is connected to an associated chain 106, which rotatably drives two spaced-apart sprockets 108. As sprockets 108 rotate, they in turn rotate cranks 112, which are pivotally connected to Pitman arms 110. The end of one Pitman arm is pivotally connected to top panel 98, and the end of the other Pitman arm is connected to bottom panel 100. Rotation of cranks 112 thus moves the top panel upwardly and the bottom panel downwardly, separating the two panels sufficiently so that wires 54 readily pass between them. Once a selected wire 114 is positioned between top panel 98 and bottom panel 100, pressurized air is applied on an opposite side of the internal pistons within pneumatic cylinders 102, causing drive tangs 104 to reverse direction, thereby moving the top and bottom panels toward each other.

Figure 7:
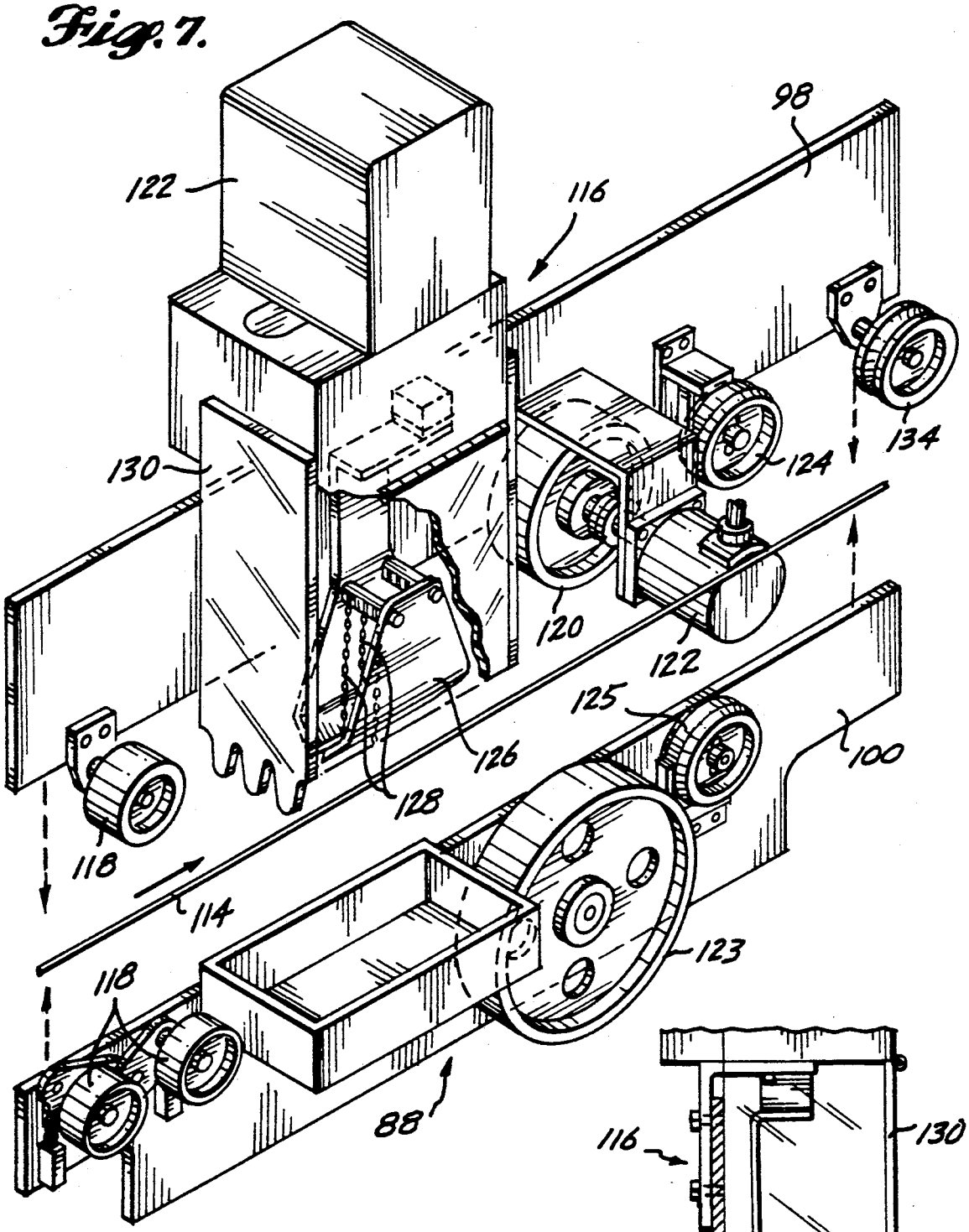
FIG. 7 is an isometric view of the assembly shown in FIGS. 4, 5, and 6.
Figure 8:
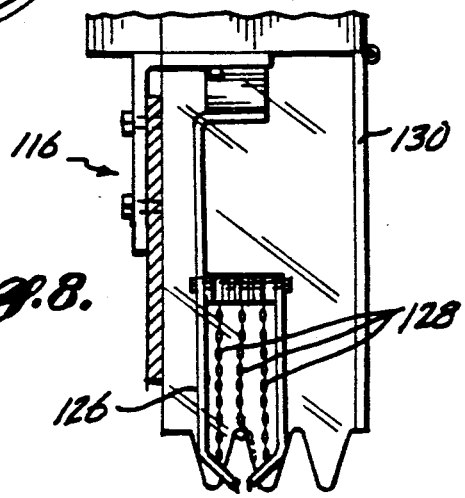
FIG. 8 is an elevational view of the assembly shown in FIGS. 4, 5, 6, and 7.

Two guide wheels 118 are mounted on bottom panel 100, and a third guide wheel 118 is mounted on top panel 98, as shown in FIG. 7. As the top and bottom panels are moved toward each other, selected wire 114 is captured between these three guide wheels. Immediately downstream of guide wheels 118 is disposed a pinch mark detector 116, which produces a signal indicative of the presence of a pinch mark (or splice) in selected wire 114. Pinch mark detector 116 comprises a housing 130 under which selected wire 114 extends. Inside housing 130 are disposed a plurality of chain-like electrodes 128 that brush against selected wire 114 as it is advanced through sensor assembly 88. An electrical charge of several thousand volts is applied to chain-like electrodes 128. A pinch mark applied to selected wire 114 at least partially perforates the insulation of the wire, changing its capacitance. When a pinch mark or a splice in the selected wire contacts chain-like electrodes 128, the capacitance presented to the charge applied to the chain-like electrodes changes. A control 132 responds to the variation in capacitance caused by a pinch mark or splice in selected wire 114, producing a signal that is input to control 82.

As explained above, pinch marks may be applied to wires 54 at predetermined intervals as the wires are wound onto reels 52, using a Conrac machine. However, for some types of wires, it may be preferable to measure the actual length of the wire as it is coiled by auto cut, coil, and tie system 50, stopping the coiling process when the desired length is reached. Accordingly, on top panel 98 is mounted a length sensor 122, which is coupled to a length measuring wheel 120 that measures the length of selected wire 114 as the wire is advanced through sensor assembly 88. A wheel 123, which is rotatably mounted to bottom panel 100, presses selected wire 114 against length measuring wheel 120. In the preferred embodiment, the circumference of length measuring wheel 120 is 12 inches. For each rotation of length measuring wheel 120, length sensor 122 produces a pulse signal indicating that 12 inches of selected wire 114 has advanced through sensor assembly 88.

Since pinch mark detector 116 does not distinguish between a pinch mark and a splice, a splice detector wheel 124 is provided for this purpose. Splice detector wheel 124 is rotatably attached to top panel 98, but is electrically insulated from the panel. Selected wire 114 is captured between splice detector wheel 124 and a wheel 125 that is rotatably attached to bottom panel 100. When a splice passes between these two wheels, the exposed conductor at the splice completes a circuit between splice detector wheel 124 and ground, producing a signal indicative of the presence of a splice. Although a pinch mark partially exposes the conductor within a wire so as to change its capacitance, there is still sufficient insulating material on the wire at a pinch mark to prevent electrical continuity from being established between splice detector wheel 124 and wheel 125 through the wire conductor at a pinch mark. Therefore, a splice passing between splice detector wheel 124 and wheel 125 is readily differentiated from a pinch mark. Detection of splices in selected wire 114 is important, since a length of wire in which a splice exists should not be used in preparing a wire bundle. Any portion of a wire that has been advanced through sensor assembly 88 in which a splice is detected is cut immediately upstream of the splice and discarded.

Figure 10:
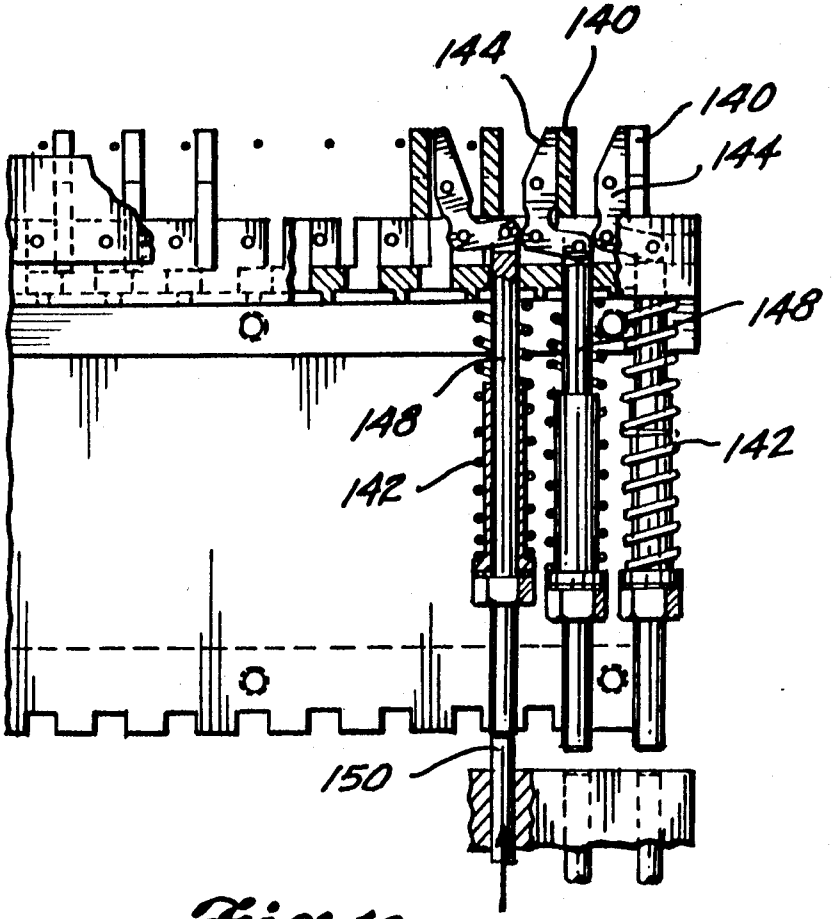
FIG. 10 is a side elevational view of the portion of the wire clamp assembly.
Figure 9:
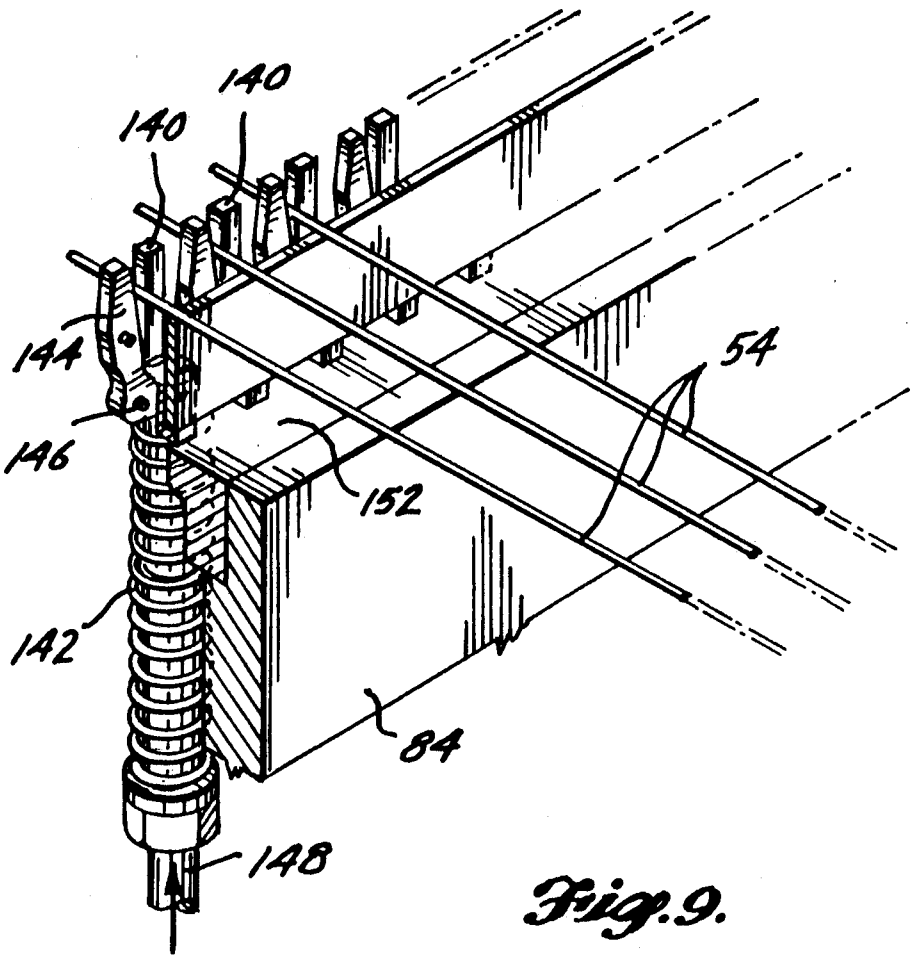
FIG. 9 is an isometric view of a portion of a wire clamp assembly that is disposed on the wire select shuttle assembly.
Figure 11:
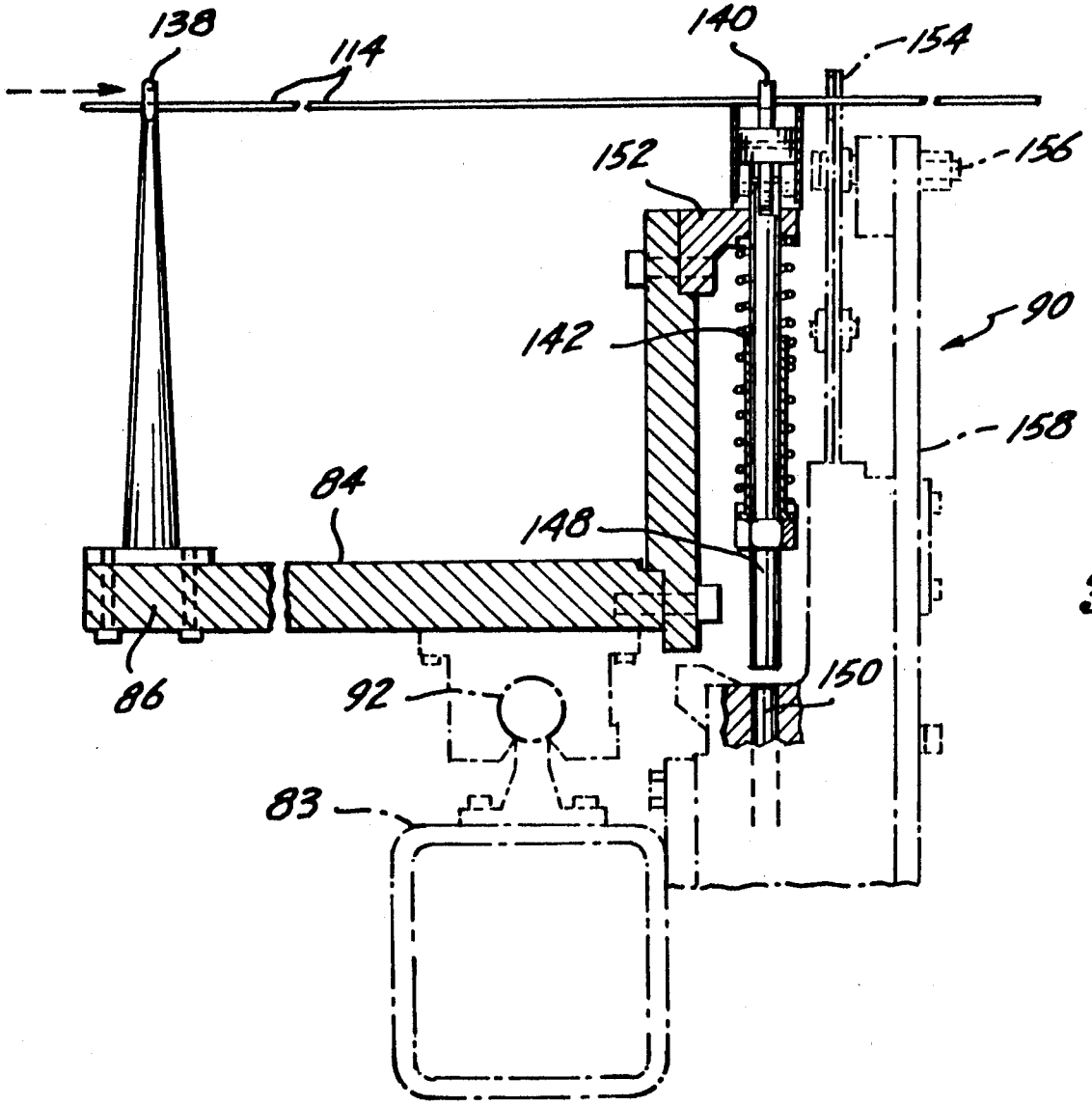
FIG. 11 is an end view of the wire clamp assembly and of a wire shear used to cut a wire after coiling.

Top panel 98 also includes a grooved guide wheel 134 that supports the wire as it is drawn through the sensor assembly and coiled. Guide wheel 134 is disposed adjacent a plurality of wire clamps 140 that extend longitudinally along one side of wire select assembly 56 and hold the ends of wires 54 until one of the wires is selected for coiling by control 82. Details of wire clamps 140 are shown in FIGS. 9 through 11. Each of wire clamps 140 in the preferred embodiment of the present invention include a pivotal jaw 144 that pivots about a pin 146. A helically coiled spring 142 provides a biasing force acting against a rod 148, which is attached to pivotal jaw 144 on each of the clamps. This biasing force tends to close the pivotal jaw. As a result, wire clamps 140 are normally biased closed, to grasp and hold the ends of wires 54. As rod 148 is forced upwardly, pivotal jaw 144 rotates open about pin 146, releasing the selected wire held by the clamp.

As shown in FIGS. 10 and 11, an actuator pin 150 is moved upwardly against the lower end of rod 148 to open one of clamps 140. Only the specific clamp 140 that is gripping selected wire 114 is opened by actuator pin 150. At all other times (except when one of reels 52 must be replaced and the wire contained on the replacement reel threaded into wire select assembly 56), clamps 140 remain closed, holding the ends of wires 54 in place.

Figure 14:
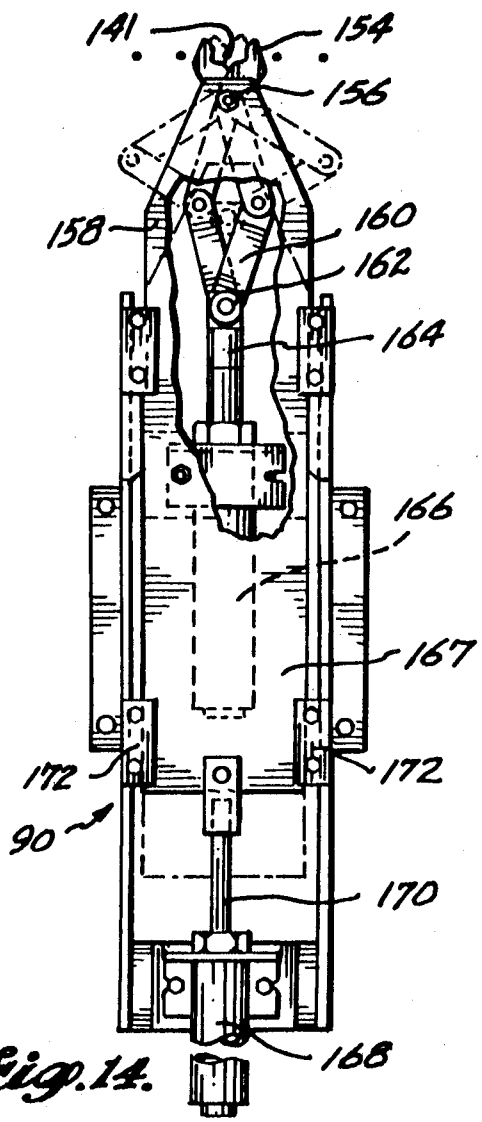
FIG. 14 is a cross-sectional view of the wire shear, taken along section line 14—14 in FIG. 12.
Figure 12:
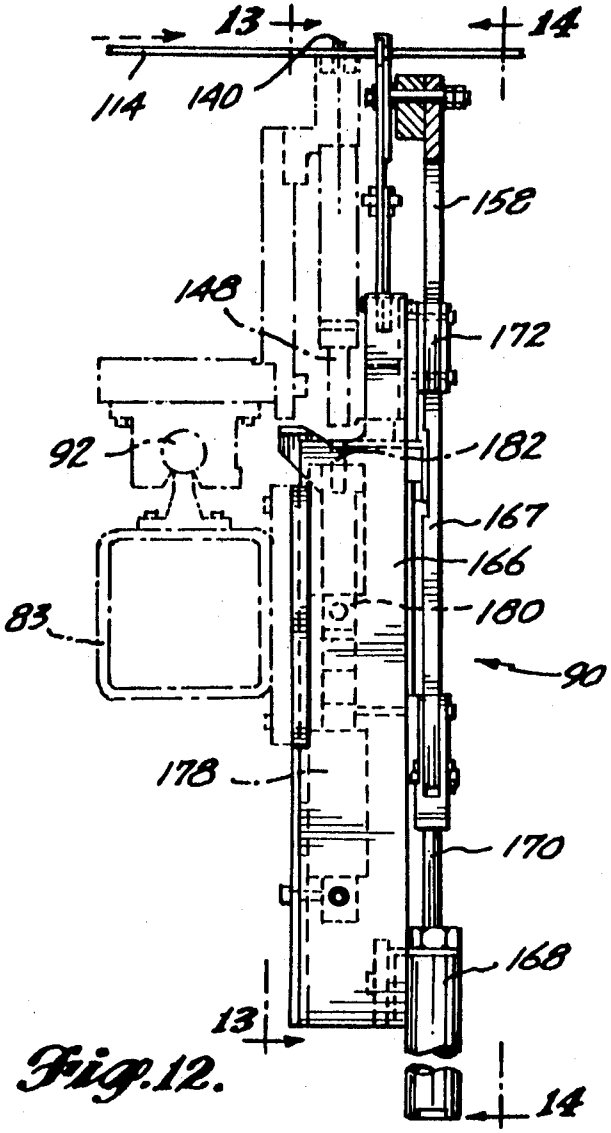
FIG. 12 is an end view illustrating the wire shear and a portion of a clamp actuator.
Figure 13:
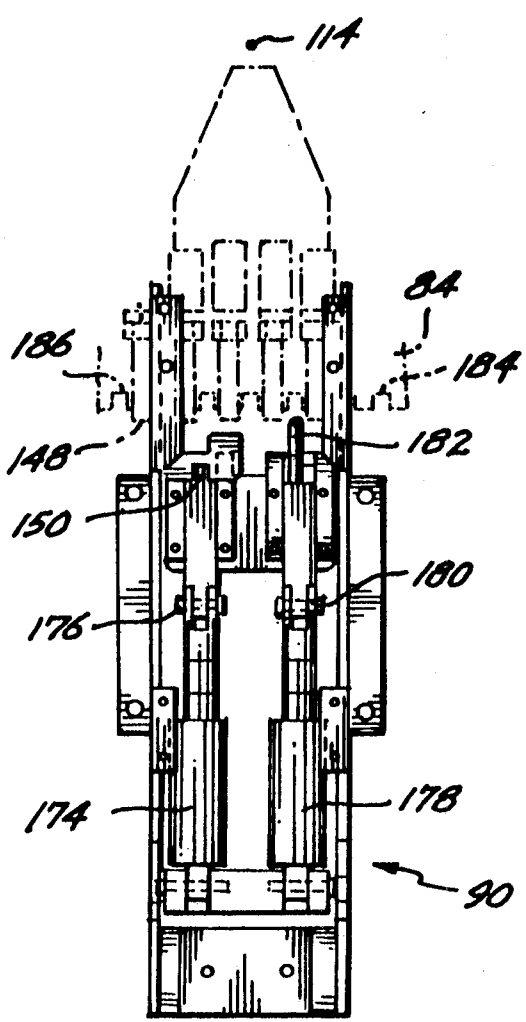
FIG. 13 is a cross-sectional view of the clamp actuator, taken along section line 13—13 in FIG. 12.
Figure 15:
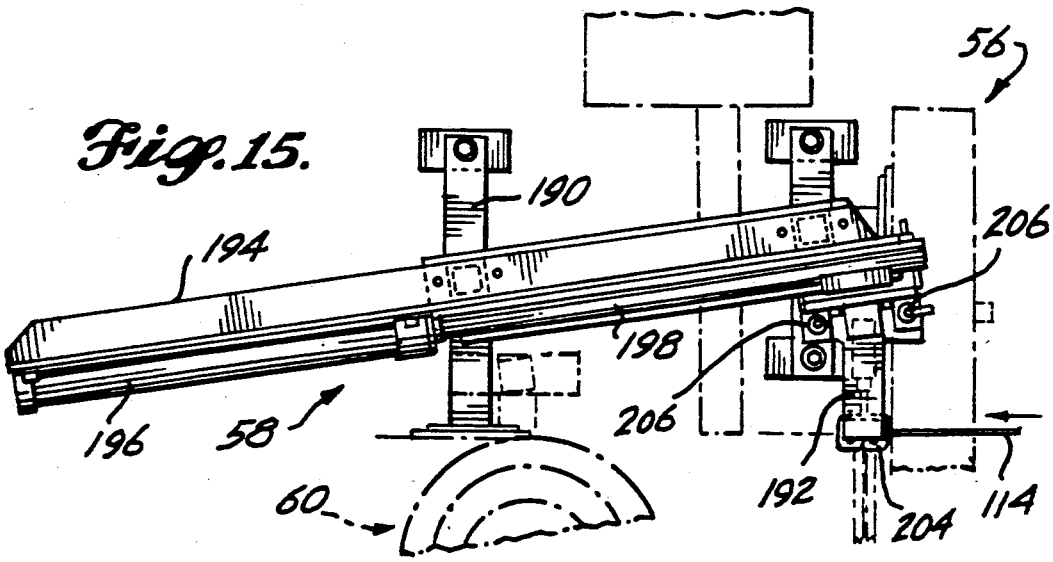
FIG. 15 is a plan view of the wire feed assembly.
Figure 16:
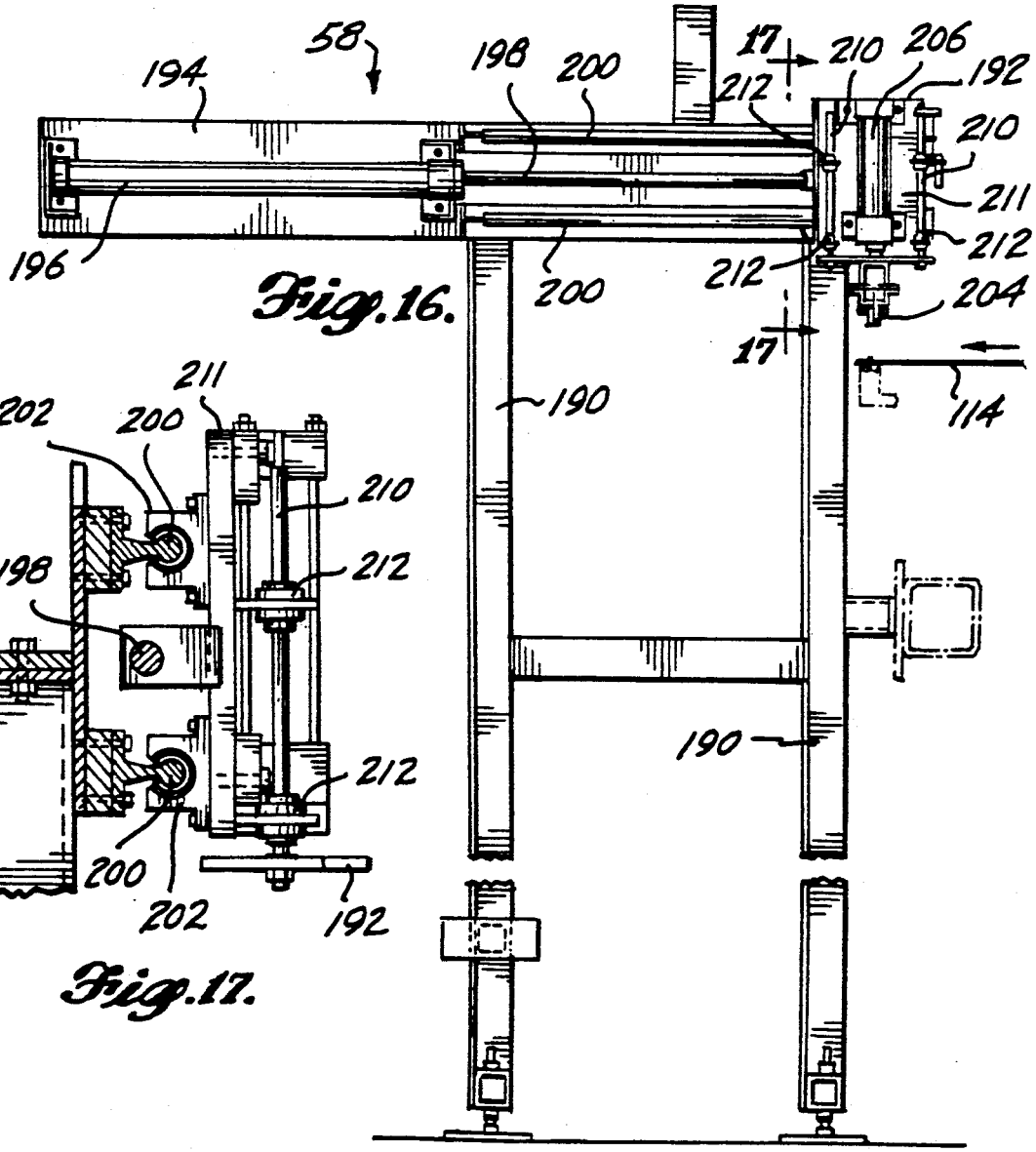
FIG. 16 is an elevational side view of the wire feed assembly.
Figure 17:
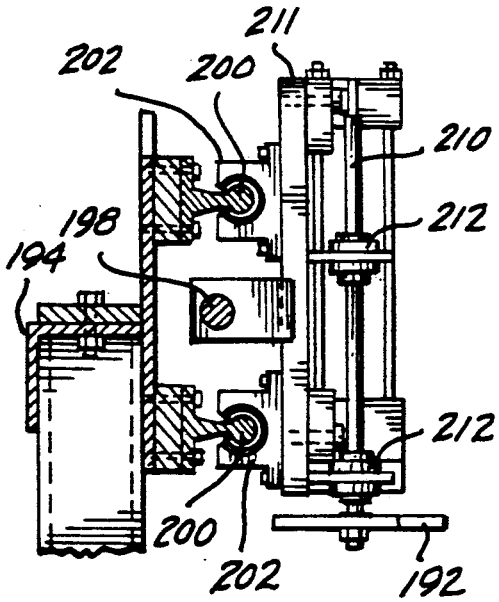
FIG. 17 is an elevational end view of the wire feed assembly.

A shear and index assembly 90 is mounted to base 83, adjacent actuator pin 150. (Further details of shear and index assembly 90 are illustrated in FIGS. 12 through 14.) A pneumatic cylinder 174 is connected through a linkage 176 to move actuator pin 150. Adjacent pneumatic cylinder 174 is disposed a pneumatic cylinder 178 that is connected through a linkage 180 to an indexing pin 182. Indexing pin 182 is forced upwardly by pneumatic cylinder 178 and seats within a notch 184, thereby precisely indexing movable frame 84 in the position required to advance selected wire 114. One notch 184 is provided for each wire 54 to properly position movable frame 84 when the wire is selected for coiling. Once indexing pin 182 is seated within the appropriate notch 184, top panel 98 and bottom panel 100 (shown in FIG. 7), are moved toward each other by actuating pneumatic cylinders 102, as previously explained, with the assurance that selected wire 114 is precisely positioned within sensor assembly 88, aligned with the guide wheels and other components mounted on the top and bottom panels.

Referring now to FIGS. 12 and 14, details of a shear 154 are shown. A pneumatic cylinder 168 is mounted at the bottom of shear and index assembly 90 and includes an elevation rod 170, which is connected to a plate 167. Plate 167 is slidably mounted under brackets 172 so that application of pressurized air to pneumatic cylinder 168 forces the plate upward, elevating shear 154 to cut selected wire 114. A pneumatic cylinder 166 is mounted to plate 167. The distal end of a rod 164 that is connected to a piston (not shown) in pneumatic cylinder 166 is pivotally attached to a compound lever 160. An upper end of the compound lever comprises the cutting jaws of shear 154, and is pivotally connected to a top portion 158 of plate 167. As rod 164 is driven upwardly by the application of pressurized air to pneumatic cylinder 166, compound lever 160 multiplies the force applied by pneumatic cylinder 166, enabling shear 154 to easily cut even a relatively large gauge wire.

Wire Feed Assembly

FIGS. 15 through 19B illustrate details of wire feed assembly 58, which is used to draw selected wire 114 from wire select assembly 56 and to position it on coiling assembly 60. The wire feed assembly comprises a frame 190 and a horizontal arm 194. From horizontal arm 194 laterally extends a clamp head 192. Clamp head 192 is driven longitudinally along horizontal arm 194 by a clamp head pneumatic cylinder 196. An actuator rod 198 extends from clamp head pneumatic cylinder 196 and is attached to clamp head 192. Clamp head 192 is connected to sliding bearing guides 202, which ride on a pair of horizontal rails 200. Horizontal arm 194, on which rails 200 are mounted, extends at an acute angle relative to the forward side of wire select assembly 56, i.e., from a position adjacent clamps 140 toward coiling assembly 60. Application of pressurized air to the clamp head pneumatic cylinder causes an internal piston (not shown) to move actuator rod 198 and the clamp head bi-directionally along horizontal rails 200.

Figure 18:
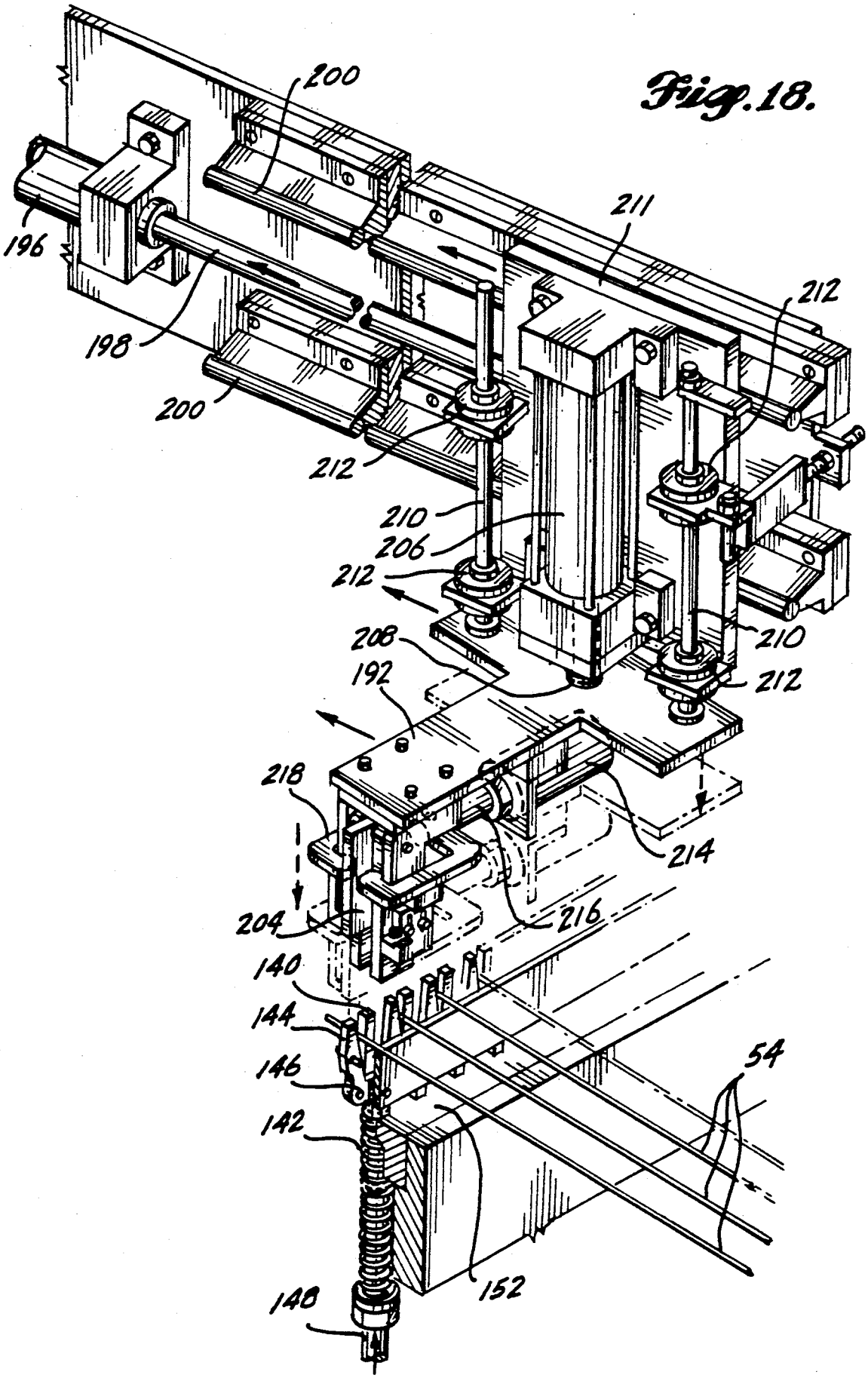
FIG. 18 is an isometric view of the wire clamp assembly and of a translational clamp disposed on the wire feed assembly.

In order to grip the extending end of selected wire 114, control 82 advances clamp head 192 along rails 200 by applying pressurized air to clamp head pneumatic cylinder 196 until a feed clamp 204 on clamp head 192 is positioned immediately above the end of the selected wire. As shown in FIG. 18, a pneumatic cylinder 206 that is attached to a plate 211 vertically moves a rod 208 to raise and lower clamp head 192. As the clamp head moves up or down, guide rods 210 that are attached to the top of clamp head 192 slide through bushings 212, which are mounted on plate 211.

FIGS. 19, 19A, and 19B illustrate details of feed clamp 204. Depending from clamp head 192 is a feed clamp pneumatic cylinder 214, which actuates a driver pin 216 to move a generally "C-shaped" actuator 218. Actuator 218 acts on two feed clamp jaws 220 that are each pivotally mounted on pins 222, causing them to pivot in opposition to a spring-bias force provided by helically coiled springs 224. Feed clamp jaws 220 thus close against corresponding opposing fixed jaws 226 to grip selected wire 114. Feed clamp pneumatic cylinder 214 operates bi-directionally, allowing feed clamp jaws 220 to open under the biasing force supplied by helically coiled springs 224 when selected wire 114 is released.

After feed clamp 204 has gripped the extending end of selected wire 114, which is held in one of the clamps 140, control 82 opens that clamp 140 and actuates pneumatic cylinder 206 to move clamp head 192 vertically upward, lifting selected wire 114 out of the open clamp. Thereafter, control 82 actuates clamp head pneumatic cylinder 196 to draw clamp head 192 horizontally toward coiling assembly 60, positioning the feed clamp directly above the coiling assembly. Pneumatic cylinder 206 is then actuated to lower clamp head 192, transferring selected wire 114 onto the coiling assembly.

Coiling Assembly

Figure 20:
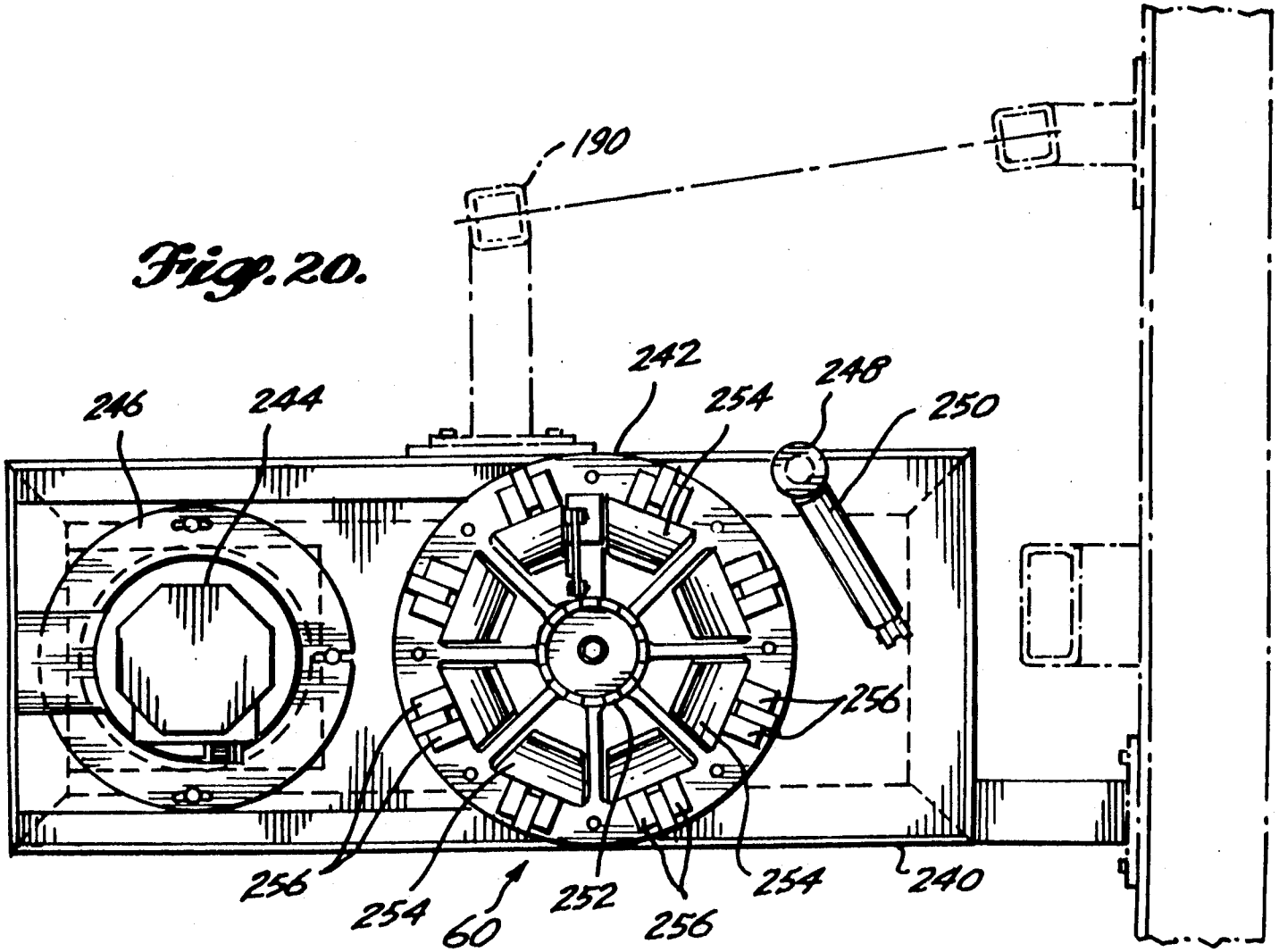
FIG. 20 is a plan view of a coiling spindle assembly.
Figure 23:
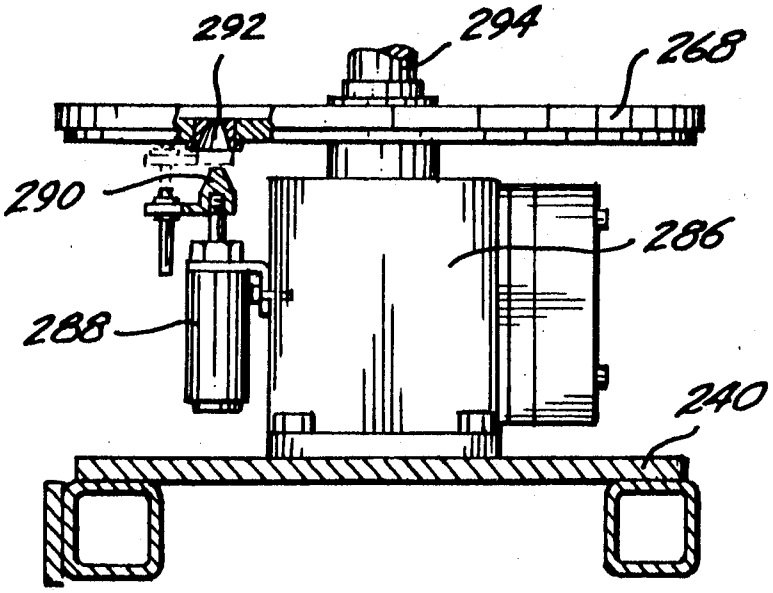
FIG. 23 is a cross-sectional view, in elevation, of the base of the coiling spindle assembly, partially cut away to illustrate an indexing pin boss.
Figure 24:
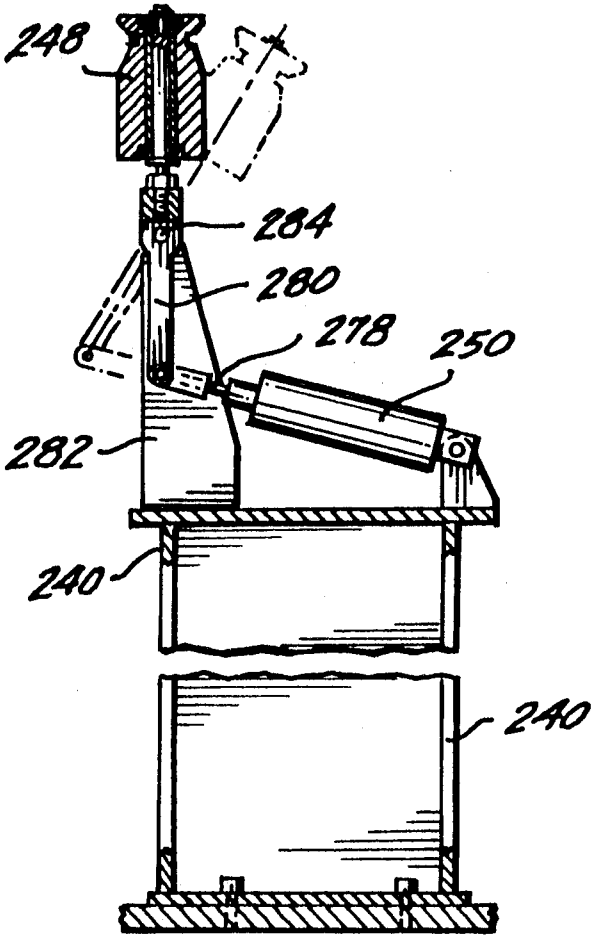
FIG. 24 is an elevational view of a portion of the coiling spindle assembly, showing a pivotal wire guide and its actuator.

Details of coiling assembly 60 are illustrated in FIGS. 20 through 24. As shown in FIG. 20, the coiling assembly comprises a coiling spindle 242, which is rotatably mounted upon a base 240. Coiling spindle 242 is drivingly rotated about its central longitudinal axis by a motor 244. As the coiling spindle rotates, it draws selected wire 114 through wire select assembly 56 from one of the reels 52, until a predetermined length has been coiled around coiling spindle 242 (or alternatively, until either all of the wire on the reel runs out or a splice is detected in the wire being coiled). Motor 244 extends above base 240, but is enclosed within a cover 246. Also mounted on base 240 is a pivoting guide roller 248, which is actuated by a pneumatic cylinder 250. Pneumatic cylinder 250 pivots guide roller 248 between a vertical position to guide selected wire 114 as a ten-inch (inside) diameter wire coil is wound, and an angled position when a seven-inch (inside) diameter coil is wound.

Coiling spindle 242 is illustrated more clearly in FIG. 22. The coiling spindle can form coils of two different sizes to accommodate different lengths and different gauges of wire. To provide this capability, coiling spindle 242 includes a plurality of coil form segments 254, which are pivotally mounted to brackets 256 that extend upwardly from a top plate 257 of the coiling spindle. Each coil form segment pivots about a pivot pin 258 between a position in which the coil form segments generally define a cylindrical surface for winding selected wire 114 to form a seven-inch diameter coil, and a second position in which the coil form segments generally define a cylindrical surface for forming a ten-inch diameter wire coil. Segment pneumatic cylinders 266 move rods 296 that are pivotally connected to the back of coil form segments 254, to pivot the segments between the two positions required to form coils of the above-described diameters, i.e., between the position for forming seven-inch diameter wire coils and the position for forming ten-inch diameter wire coils. The lower end of segment pneumatic cylinders 266 are connected to a bottom plate 268 and are rotatably driven with it by motor 244.

A belt 260 extends between pulleys 262, one of which is disposed on motor 244 and the other of which is disposed on the lower end of coiling spindle 242. Top plate 257 is attached through a plurality of support posts 270 to bottom plate 268. In FIG. 22, for the sake of clarity, only one of the eight coil form segments 254 and one of the eight segment pneumatic cylinders 266 comprising coiling spindle 242 are shown.

Also mounted on top plate 257 is an index hub 152 in which are formed a plurality of slots 298, each slot corresponding to the position of gaps between adjacent coil form segments 254. The purpose of index hub 152 is explained below.

A wire clamp 275 is disposed on top plate 257 and includes a pivotal jaw 274 that clamps selected wire 114 against a fixed jaw 272. Pivotal jaw 274 is connected to a wire clamp pneumatic cylinder 276, which is mounted to a shaft 294 of coiling spindle 242. Pneumatic lines that supply pressurized air to wire clamp pneumatic cylinder 276 and the segment pneumatic cylinders through shaft 294 of coiling spindle 242 via a two-port rotary union are not shown. Wire clamp pneumatic cylinder 276 is actuated by this pressurized air, causing wire clamp 275 to grip the end of selected wire 114 as feed clamp 204 lowers the selected wire onto the coiling assembly. Only after wire clamp 275 secures the end of selected wire 114 does feed clamp 204 open to release its grip on the wire.

While selected wire 114 is transferred from feed clamp 204 to wire clamp 275, coiling spindle 242 is locked in a "home position" by an indexing pin 290. Indexing pin 290 is forced vertically upward to seat within an indexing boss 292 by a home index pneumatic cylinder 288, which is mounted on a bearing base 286 underneath bottom plate 268. The seating of indexing pin 290 in indexing boss 292 insures that coiling spindle 242 always starts winding a coil of wire from its home position.

Pick and Place Assembly

Figure 25:
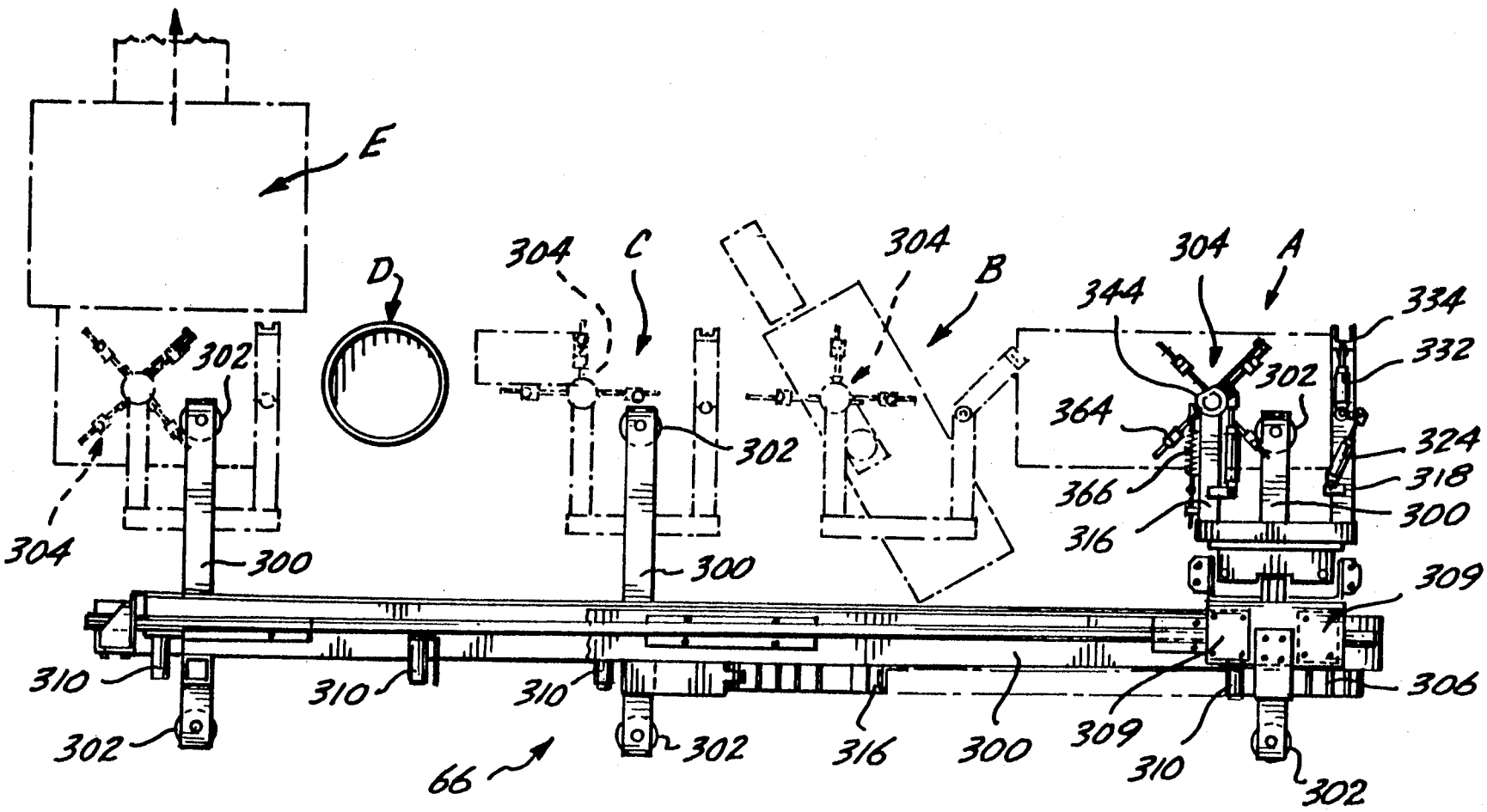
FIG. 25 is a plan view of a pick and place assembly, illustrating its position at other stations in phantom aspect.
Figure 26:
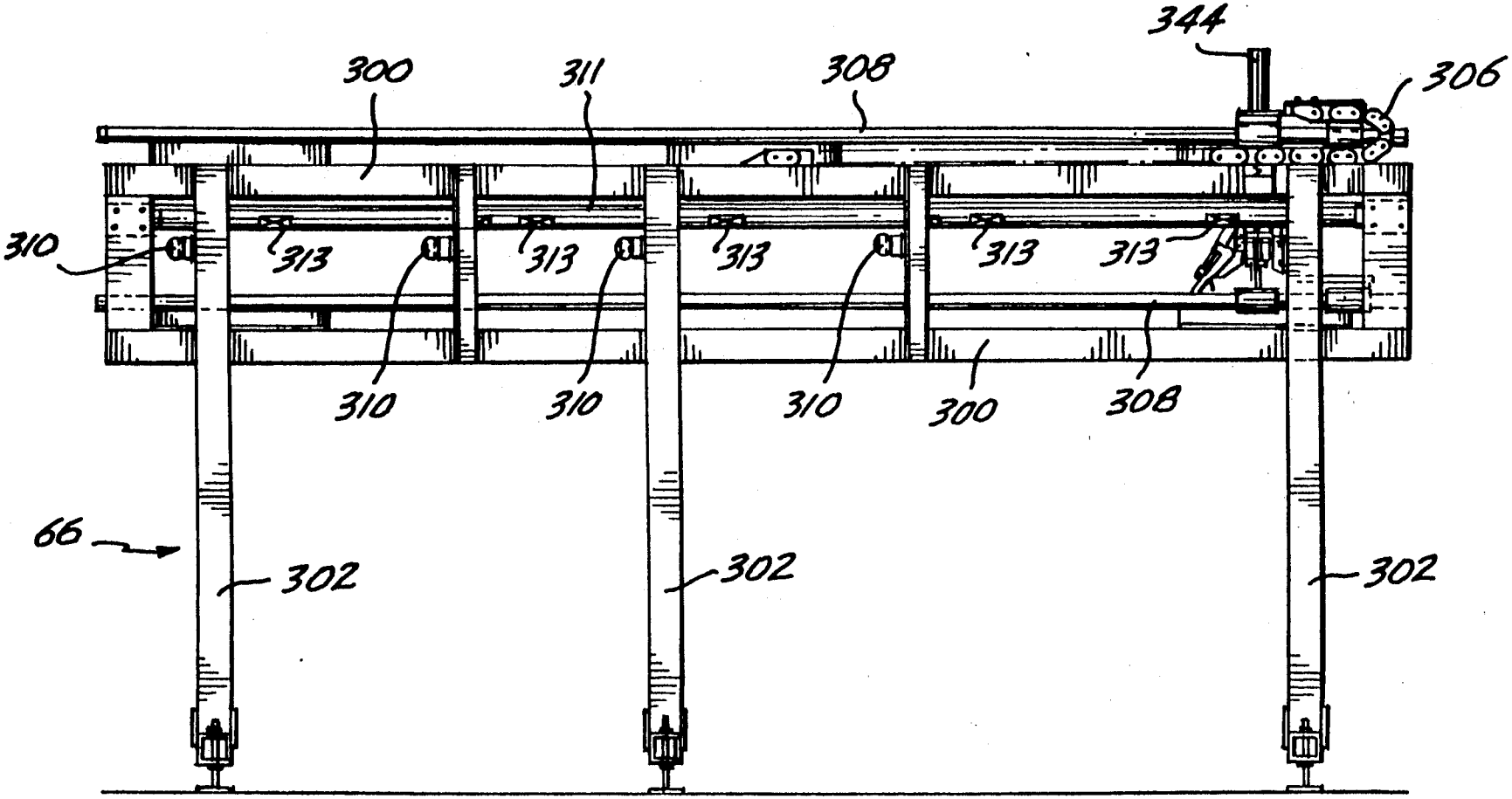
FIG. 26 is a side elevational view of the pick and place assembly.

FIGS. 25 through 30 illustrate details of pick and place assembly 66. This assembly comprises a horizontal frame 300 supported on a plurality of spaced-apart vertical posts 302. Horizontal frame 300 extends adjacent five stations at which the pick and place assembly is selectively stopped to pick up, have tied, or deposit wire that is coiled and tied. In FIG. 25, these five stations are lettered A through E. A pick and place head 304 on the assembly that moves the coiled wire from station to station is shown at station A and in phantom view, at Stations B, C, and E.

The operation of pick and place head 304 uses a number of pneumatic lines (not shown) through which pressurized air is provided. Since the pick and place head moves a substantial horizontal distance while traversing between Stations A and E, a chain-link tubing carrier 306 is provided to protect the pneumatic tubing. One end of carrier 306 is mounted on the pick and place head for movement along horizontal frame 300, and the other end is fixed at the point where the plurality of air lines that supply pressurized air to the pick and place head feed through the horizontal frame. The pneumatic lines are enclosed within carrier 306 and prevented from tangling or chaffing, since the carrier neatly folds over in a loop when pick and place head 304 moves along horizontal frame 300, as shown at the upper right corner of FIG. 26.

A pair of horizontally extending rails 308 support pick and place head 304 as it moves along the pick and place assembly. Pick and place head 304 is mounted on a carriage 315 that is attached to a plurality of journal bearings 309, which ride along rails 308. The force required to move pick and place head 304 along rails 308 is provided by a double-acting rodless pneumatic cylinder 311, which extends generally from one end of pick and place assembly 66 to the other. Alternatively, an electric linear actuator can be used for this purpose in place of the rodless pneumatic cylinder.

Rodless pneumatic cylinder 311 operates at two different speeds. Control 82 regulates the application of pressurized air to rodless pneumatic cylinder 311, selectively controlling its speed in response to signals produced by a plurality of reed switches 313. Reed switches 313 are disposed at spaced-apart intervals adjacent to and along the longitudinal axis of rodless pneumatic cylinder 311. Two such reed switches are provided for each of Stations A through E. The rodless pneumatic cylinder initially moves pick and place head 304 between these stations at the higher of its two speeds, but upon passing a reed switch 313 that is disposed just before the station at which the pick and place head is next required to stop, control 82 changes the flow of pressurized air applied to rodless pneumatic cylinder 311, thereby slowing the pick and place head to the lower speed so that it can stop upon reaching the next reed switch 313, which is disposed at the station.

A plurality of indexing pneumatic cylinders 310 are mounted at spaced-apart locations along frame 300 at each precise position where pick and place head 304 is required to stop at one of the stations. Indexing pneumatic cylinders 310 are each equipped with an indexing pin 312 that is driven by pressurized air into an indexing boss 314 disposed on carriage 315. Indexing pin 312 thus stabilizes and locates pick and place head 304 precisely when it stops at each of Stations A through E.

Figures 27, 27A:
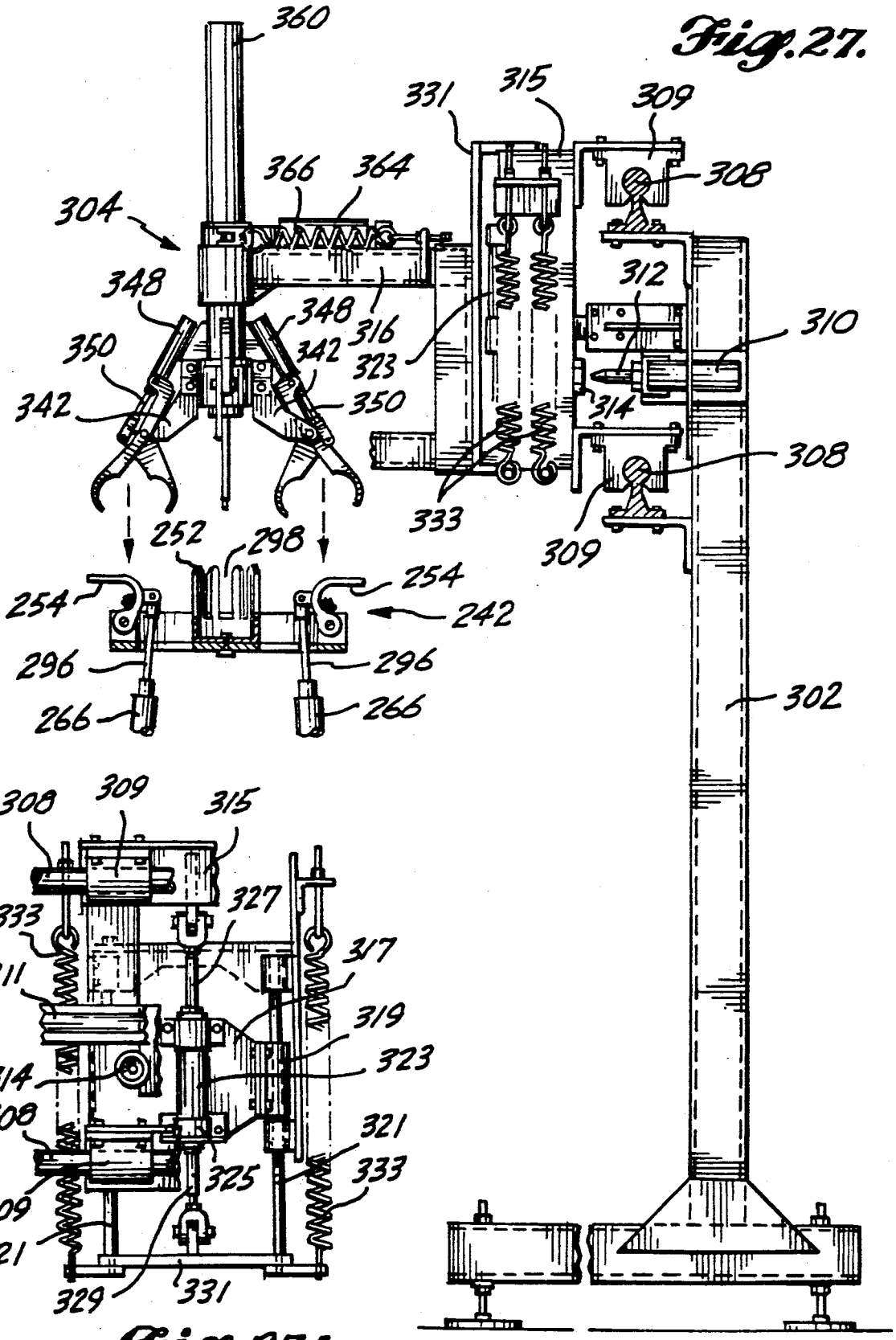
FIG. 27 is an end view showing the pick and place assembly positioned to pick-up a coil of wire from the coiling spindle assembly.
FIG. 27A is an elevational cross-sectional view of the pick and place assembly.

Internal details of carriage 315 in the pick and place head are illustrated in FIG. 27A. Within carriage 315, a plate 317 is mounted on linear bearings 319, which slide along rods 321. Mounted on opposite sides of plate 317 are double-acting pneumatic cylinders 323 and 325. Pneumatic cylinder 323 includes an upwardly extending actuator rod 327, which is connected to carriage 315. When pressurized air is applied to pneumatic cylinder 323, actuator rod 327 is extended, forcing plate 317 to move vertically downward within carriage 315. Likewise, an actuator rod 329 extends downwardly from pneumatic cylinder 325 and is attached to a support plate 331 on which pick and place head 304 is directly mounted. As pressurized air is applied to pneumatic cylinder 325, actuator 329 extends downwardly, thereby further lowering support plate 331 (and pick and place head 304).

A plurality of coiled helical springs 333 extend vertically along the exterior edges of carriage 315, between carriage 315 and support plate 331. Springs 333 provide a biasing force tending to move the pick and place head vertically upward, and compensating for its weight so that it "floats." Because of the biasing force provided by springs 333, pneumatic cylinders 323 and 325 can more easily raise pick and place head 304. In the preferred embodiment, when properly actuated with pressurized air, pneumatic cylinder 323 moves plate 317 and pick and place head 304 downwardly 2.75 inches to an "indexing position." When pneumatic cylinder 325 is activated, it lowers the pick and place head an additional 2.75 inches, placing it in an "operating position."

Referring now to FIGS. 27, 28, 28A, and 28B, details of pick and place head 304 are more clearly illustrated. Pick and place head 304 is mounted on a forward lateral arm 316, which is attached to support plate 331. A rotational pneumatic cylinder 364 is mounted generally parallel to forward lateral arm 316 and includes an actuator rod 368, which is attached to one of two brackets 370 that project outwardly from opposite sides of a central hub 344 on the pick and place head. A coiled helical spring 366 extends from the other bracket 370 back along the opposite side of forward lateral arm 316 and is operative to provide a biasing force that rotates central hub 344 counterclockwise, as viewed in FIG. 29. Thus, extension of actuator rod 368 from rotational pneumatic cylinder 364 is assisted by the biasing force provided by coiled helical spring 366, causing pick and place head 304 to rotate counterclockwise. Conversely, retraction of actuator rod 368 in response to pressurized air applied at an opposite end of rotational pneumatic cylinder 364 rotates pick and place head 304 clockwise.

Inside central hub 344 is disposed a vertical pneumatic cylinder 360 that is connected to an index sensor 372 through an actuator rod 362. Actuator rod 362 extends vertically along the longitudinal axis of central hub 344. Application of pressurized air to vertical pneumatic cylinder 360 causes index sensor 372 to move vertically downward into a position where it can detect alignment with one of the slots 298 on an index hub 252. The index sensor preferably comprises a reed switch or other position sensing device that produces a signal usable by control 82 to rotate pick and place head 304 to align with coiling spindle 242 (see FIG. 22). Alignment of pick and place head 304 in this manner is required to permit coiled wire to be removed from the coiling spindle and is accomplished by control 82 actuating rotational pneumatic cylinder 364 to rotate the pick and place head as required. Index sensor 372 thus determines if the aligned rotational position of the pick and place head has been achieved before the pick and place head is lowered to the operating position over the coiling spindle to pick up the coiled wire.

Figure 29:
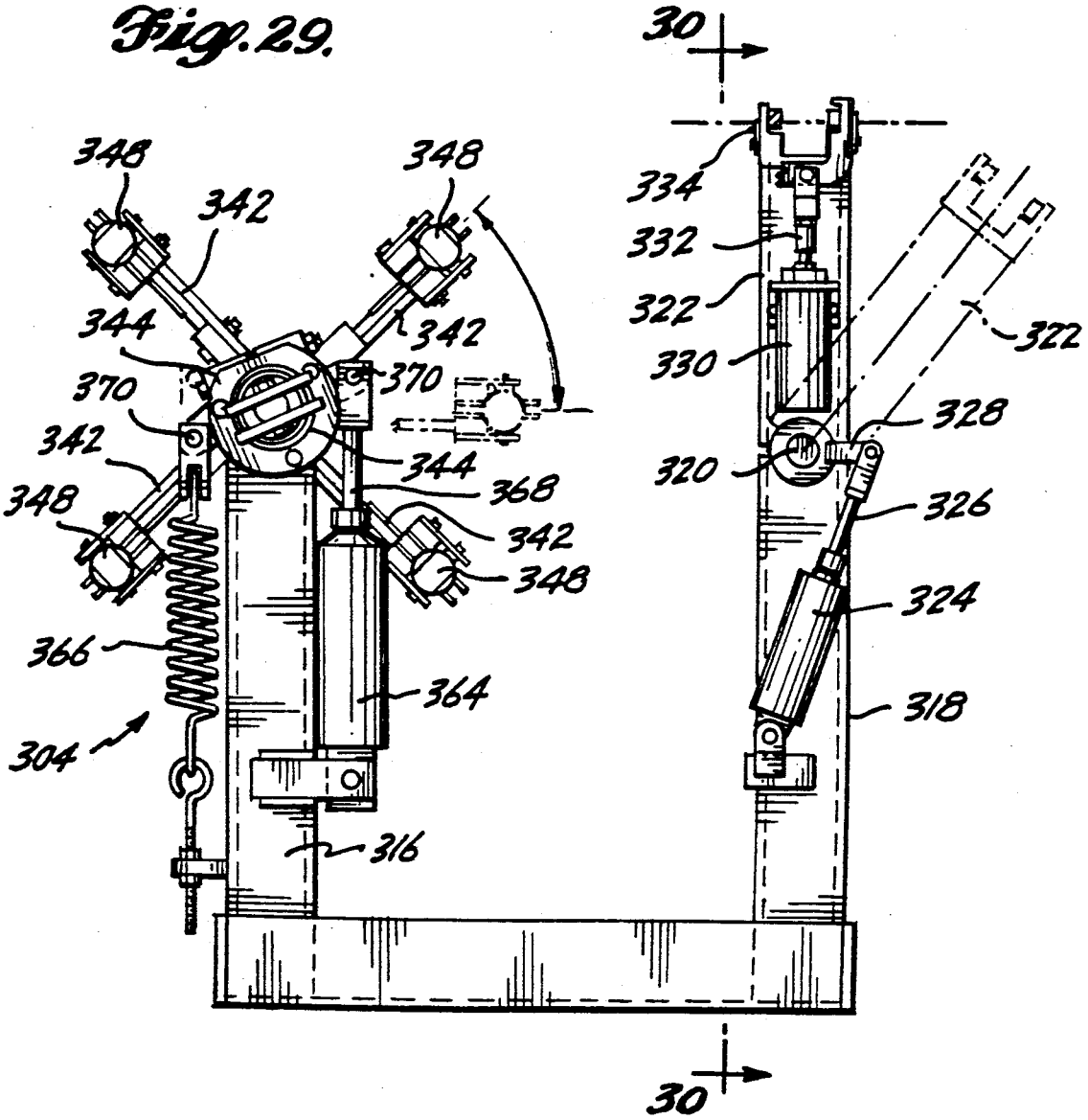
FIG. 29 is a plan view of a portion of the pick and place assembly.
Figure 30:
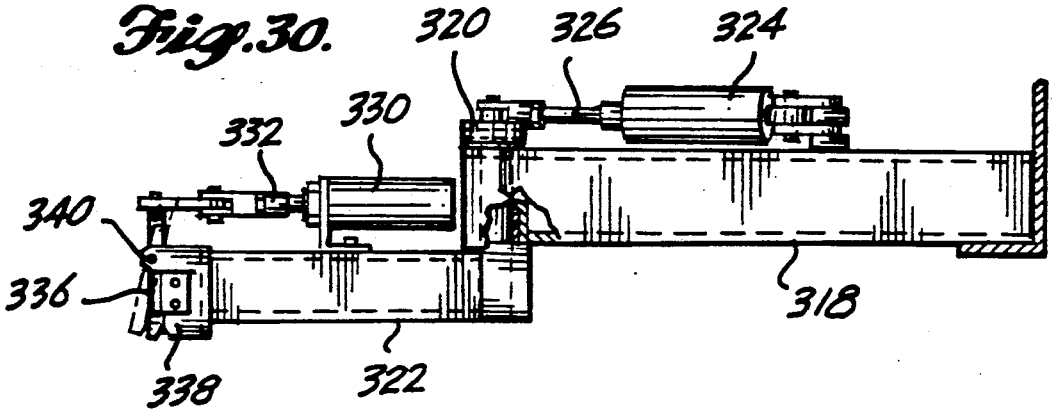
FIG. 30 is a cross-sectional view of a portion of the pick and place assembly, taken along section line 30—30 in FIG. 29.

Referring now to FIGS. 29 and 30, pick and place assembly 66 includes a rear lateral arm 318 that is generally parallel with forward lateral arm 316. Rear lateral arm 318 includes a hinge 320 that enables a distal portion 322 of the arm to pivot to the position shown in the phantom view within FIG. 29. A pivot arm pneumatic cylinder 324 is connected by an actuator rod 326 to distal portion 322 of rear lateral arm 318, and provides the force necessary to swing distal portion 322 about hinge 320. On the end of rear lateral arm 318 is disposed an arm clamp 334, which includes a movable jaw 336 and a fixed jaw 338. Movable jaw 336 pivots about a pin 340 when actuated by an arm-clamp pneumatic cylinder 330, that is connected to movable jaw 336 by an actuator rod 332. Extension of actuator rod 332 from arm-clamp pneumatic cylinder 330 causes selected wire 114 to be gripped between movable jaw 336 and fixed jaw 338. The purpose of rear lateral arm 318, hinged distal portion 322, and arm clamp 334 is to maintain tension on a tag end of the coiled wire after it is cut, when the coil is rotated for tying the loops of wire.

Four radial arms 342 extend downwardly and radially outward from central hub 344 on pick and place head 304. At the distal end of each of the radial arms, a gripper 346 is pivotally mounted by a fastener 358. Grippers 346 each include an inner jaw 352, an outer jaw 354, and a gripper pneumatic cylinder 348, which is pivotally mounted to an upper end of outer jaw 354. Extending from each gripper pneumatic cylinders 348 is an actuator rod 350, which is pivotally attached by a fastener 356 to inner jaw 352. Stop pins 351 on radial arms 342 limit the extent of rotational movement of grippers 346. Full extension of actuator rod 350 from gripper pneumatic cylinders 348 causes inner jaw 352 to pivot into contact with the lowermost pin 351, thereby forcing outer jaw 354 to pivot radially outward away from inner jaw 352.

The fully open configuration of inner jaw 352 and outer jaw 354 is shown in phantom view in FIG. 28B. In this configuration, the grippers encompass wire coils having a diameter from seven to ten inches. As actuator rod 350 is retracted inside gripper pneumatic cylinder 348, outer jaw 354 and inner jaw 352 on each gripper move toward each other. If a seven-inch diameter coiled wire on the coiling spindle is first encountered by inner jaw 352, further retraction of actuator rod 350 causes outer jaw 354 to close toward inner jaw 352 until the grippers close over the coiled wire as shown in FIG. 28. However, if outer jaw 354 first encounters wire that is coiled in a ten-inch diameter coil, then the outer jaw stops pivoting and inner jaw 352 closes around the wire as shown in FIG. 28B. Thus, by allowing grippers 346 to pivotally rotate about fasteners 358, either seven- or ten-inch diameter wire coils can be seized by grippers 346 without the use of any actuating mechanism to specifically change the radial disposition of the grippers. Instead, grippers 346 automatically accommodate the two coil sizes. This capability is also shown in FIG. 27, which illustrates a portion of coiling spindle 242 as pick and place head 304 moves downwardly to grip a ten-inch diameter wire coil. The operational sequence of pick and place head 304 and its interaction with coiling spindle 242 are fully explained below.

Wire Pallet

Figure 31:
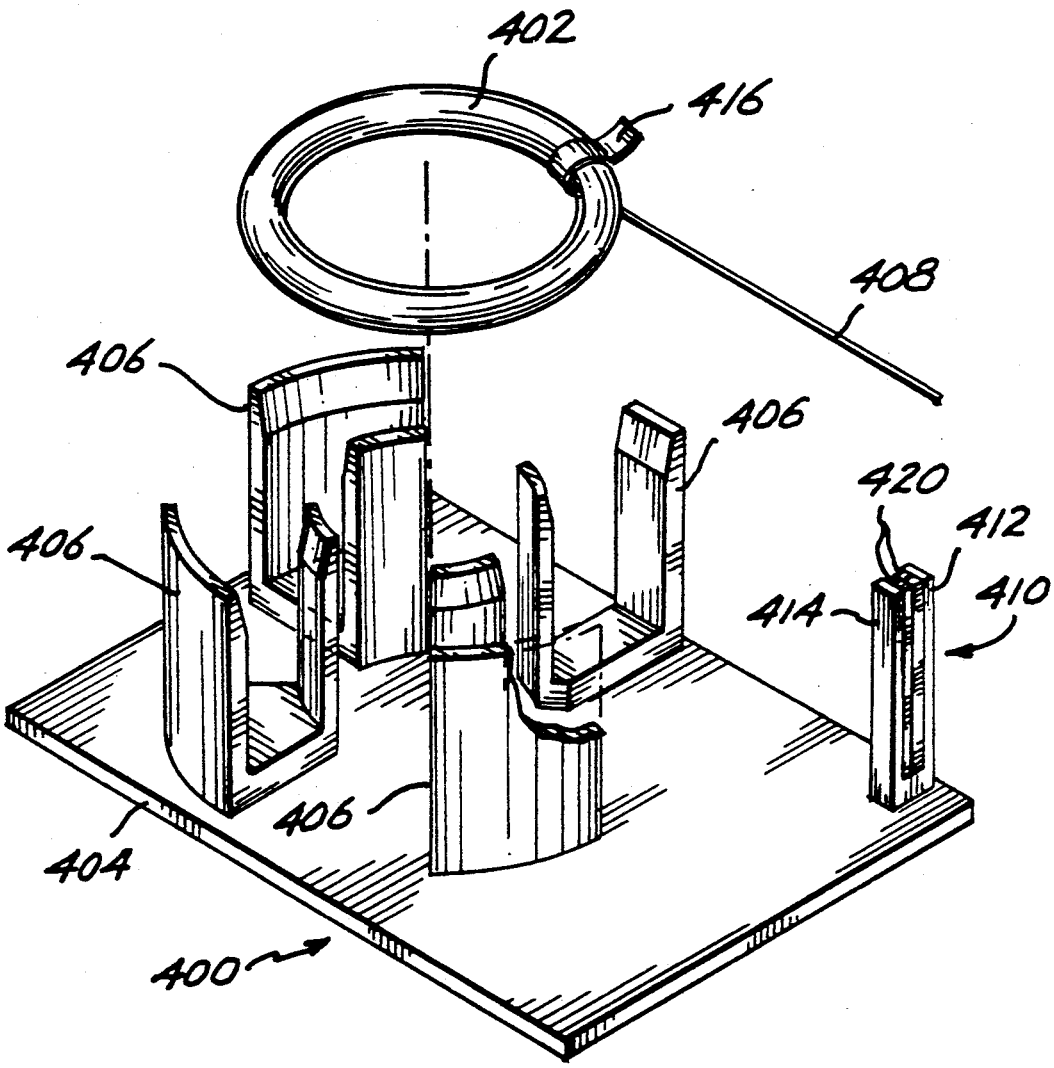
FIG. 31 is an isometric view of a wire pallet for receiving coiled, cut, and tied wires.

After pick and place head 304 has removed a coiled wire from coiling spindle 242, the coiled wire is transported to one of two different tying stations. Larger cross-sectional coils of wire are transported to Station B as shown in FIG. 25, where TACKET-TWISTER TM tying machine 61 senses the wire as it is presented for tying and applies a twist tie around the coil of wire. Coils of wire having a relatively smaller cross section (up to $\frac{5}{8}$ inches in the preferred embodiment) are instead conveyed to TIEMATIC TM tying machine 62 at Station C. Either tying machine automatically applies a tie through the coil center and around the loops to keep the wire from uncoiling when released. Thereafter, pick and place head 304 conveys a cut and tied coil of wire 402 to a pallet 400, as shown in FIG. 31. A tag end 408 of cut and tied coil of wire 402 is held by arm clamp 334 on rear lateral arm 318 as grippers 346 lower the coil onto pallet 400.

Pallet 400 comprises a base 404 on the top surface of which are provided a plurality of coil support segments 406. Grippers 346 fit between coil support segments 406 as cut and tied coil of wire 402 is lowered onto pallet 400. Tag end 408 of the wire is forced into a wire holder clamp 410, which comprises two upright jaws 412 and 414 that have a brush-like pile 420 applied along their inner facing surfaces. Arm clamp 334 forces tag end 408 down between the two upright jaws, and pile 420 tends to grab the wire, preventing it from pulling free. Additional cut and tied coils of wire 402 are similarly loaded onto pallet 400 before it is moved by conveyor 70 to the operator's workstation.

Operational Sequence for the Auto Cut, Coil, and Tie System

To simplify the disclosure of auto cut, coil, and tie system 50, the attached drawings do not show the pneumatic lines that selectively apply pressurized air to the various pneumatic cylinders described above. Application of pressurized air through these pneumatic lines is controlled by electrical solenoids, which are also not shown. Control 82 is programmed to provide the required electrical signals to these electrical solenoids in a controlled sequence and in accordance with programmed instructions as required to carry out the above-described functions. Control 82 also follows a programmed work schedule defining the specific wires 54 that are on reels 52 (shown in FIG. 1) for coiling, cutting, tying, and loading on pallet 400.

In response to the programmed instructions that are stored in nonvolatile memory within control 82, the control energizes motor 95, causing movable frame 84 to position selected wire 114 between top panel 98 and bottom panel 100 of sensor assembly 88. Control 82 responds to a signal produced by linear position sensor 94 in properly positioning movable frame 84 to accomplish this task, and stops movable frame 84 at the position required to bring selected wire 114 into alignment with sensor assembly 88.

Control 82 then enables application of pressurized air to pneumatic cylinder 178, forcing indexing pin 182 into an appropriate notch 184. This action ensures that movable frame 84 and selected wire 114 are precisely aligned. Pneumatic cylinders 102 are actuated with pressurized air, bringing top panel 98 and bottom panel 100 together, with the selected wire interposed between the two panels.

Pressurized air is selectively applied by control 82 to clamp head pneumatic cylinder 196, thereby moving clamp head 192 into position adjacent wire select assembly 56. A reed switch or other position sensor (not shown) may be employed to provide a positive feedback signal to control 82 to more accurately determine when clamp head 192 is properly positioned. Control 82 then applies pressurized air to pneumatic cylinder 206, lowering feed clamp 204 over the wire clamp 140 holding the selected wire 114. The selected wire is positioned between feed clamp jaws 220 and fixed jaws 226, and feed clamp pneumatic cylinder 214 is actuated with pressurized air by control 82, causing feed clamp jaws 220 to close against selected wire 114. Since selected wire 114 is now secured by feed clamp 204, wire clamp 140 is forced open by application of pressurized air to pneumatic cylinder 174.

Pneumatic cylinder 206 is actuated by control 82 to lift selected wire 114 from open clamp 140. Clamp head pneumatic cylinder 196 then responds to the application of pressurized air to move clamp head 192 horizontally into a position over coiling spindle 242. A reed switch or other position sensor (not shown) produces a signal causing control 82 to interrupt application of pressurized air to clamp head pneumatic cylinder 196 when feed clamp 204 is disposed immediately above wire clamp 275 on the coiling spindle.

When coiling spindle 242 is disposed at its home position, control 82 seats indexing pin 290 within indexing boss 292, thereby ensuring that coiling spindle 242 is properly positioned to accept selected wire 114 for coiling. With coiling spindle 242 thus locked in its home index position, control 82 applies pressurized air to segment pneumatic cylinders 266, causing coil form segments 254 to pivot into the position required for forming a seven-inch diameter coil. Pneumatic cylinder 206 is then actuated to lower feed clamp 204, positioning selected wire 114 within wire clamp 275. Pivotal jaw 274 is closed as wire clamp pneumatic cylinder 276 is energized with pressurized air. After wire clamp 275 has gripped selected wire 114, control 82 causes feed clamp 204 to open, and then lifts clamp head 192 away from coiling spindle 242. Clamp head pneumatic cylinder 196 is again actuated by control 82 to move clamp head 192 back toward wire select assembly 56 in preparation for advancing the next selected wire.

In response to the program data indicating the required length of selected wire 114 and its gauge, which are recorded in the work schedule, control 82 determines whether a seven-inch diameter coil or a ten-inch diameter coil is appropriate. If a ten-inch diameter coil is needed, pressurized air is applied by control 82 to segment pneumatic cylinder 266 to pivot coil form segments 254 to their ten-inch coil diameter position. Likewise, pneumatic cylinder 250 is activated to position guide roller 248 to guide selected wire 114 tangentially onto coil form segments 254. Conversely, if a seven-inch diameter coil is required, coil form segments 254 need not be pivoted, and guide roller 248 remains in its angled position to guide selected wire 114 onto the seven-inch diameter form. Control 82 then retracts indexing pin 290 from indexing boss 292, enabling motor 244 to rotate coiling spindle 242 to wind a wire coil.

Rotation of coiling spindle 242 draws selected wire 114 through sensor assembly 88 until pinch mark detector 116 detects a pinch mark, or alternatively, until length sensor 122 measures the required predetermined length of selected wire 114 drawn through sensor assembly 88. While the wire is being coiled, pick and place head 304 is moved by rodless pneumatic cylinder 311 to Station A so that the pick and place head is positioned immediately over coiling spindle 242. Control 82 applies pressurized air to pneumatic cylinder 323, lowering pick and place head 304 to its indexing position. Thereafter, control 82 energizes vertical pneumatic cylinder 360, lowering index sensor 372 onto index hub 252. In response to the signal produced by index sensor 372, the control activates rotational pneumatic cylinder 364 as required to rotate pick and place head 304 so that grippers 346 are aligned with the gaps between adjacent coil form segments 254.

Once pick and place head 304 is rotationally indexed to align with coiling spindle 242, pneumatic cylinder 325 is energized to lower pick and place head 304 to the operating position so that grippers 346 encompass the wire coiled on coil form segments 254. Pressurized air is applied by control 82 to gripper pneumatic cylinders 348, causing inner jaws 352 and outer jaws 354 to close toward each other, around the coiled wire. If the wire was coiled with a ten-inch diameter, segment pneumatic cylinders 266 are energized with pressurized air to pivot coil form segments 254 to the seven-inch diameter position, thereby releasing the coil. (No movement by coil form segments 254 is required to release a seven-inch diameter coil.) As grippers 346 close on the coiled wire, pressurized air is also applied to arm-clamp pneumatic cylinder 330, causing arm clamp 334 to close on selected wire 114. The coiled wire is thus held within grippers 346 and by arm clamp 334.

Pneumatic cylinder 174 is deactivated by control 82, enabling clamp 140 to again clamp selected wire 114. Once the wire is clamped in place, pneumatic cylinder 168 is energized, causing shear 154 to be elevated in preparation to cutting the selected wire. After shear 154 is positioned about selected wire 114, pneumatic cylinder 166 is activated, causing shear 154 to cut through the selected wire. Control 82 reopens shear 154 by applying pressurized air to the opposite side of the piston within pneumatic cylinder 166 and lowers plate 167 to which the shear is attached, by appropriately applying pressurized air to pneumatic cylinder 168.

Pivotal arm pneumatic cylinder 324 is energized with pressurized air to pivot arm clamp 334 about hinge 320 sufficiently to maintain tension on the tag end of the coiled wire. Control 82 applies pressurized air to pneumatic cylinders 323 and 325 to raise pick and place head 304 to its uppermost position, thereby lifting the coiled wire free of coiling spindle 242. The control then applies pressurized air to rodless pneumatic cylinder 311, moving pick and place head 304 to either Station B or C, depending upon the cross-sectional size of the coiled wire being conveyed by it. This programmed choice of tying devices is also provided to control 82 as part of the work schedule data. Rodless pneumatic cylinder 311 moves pick and place head 304 at its higher speed until reaching the particular reed switch 313 that is disposed before the desired Station B or C. The control responds to the signal from this reed switch by reducing the speed of the pick and place head. Pick and place head 304 is stopped by control 82 at the appropriate position in response to the signal produced by another reed switch 313. The control energizes the indexing pneumatic cylinder 310 at that station, forcing indexing pin 312 into indexing boss 314 on carriage 315.

At Station B or C, one of the tying machines inserts a strip of plastic or other tying material through the center of the wire coil and secures it in place. After a tie 416 (shown in FIG. 31) is applied to the coiled wire at either Station B or C, rodless pneumatic cylinder 311 is again activated by control 82 to move pick and place head 304 at high speed toward Station E. Two reed switches 313 provide signals enabling control 82 to slow and then stop pick and place head 304 at an appropriate point so that indexing pneumatic cylinder 310 can precisely position the pick and place head to lower cut and tied coil of wire 402 onto pallet 400 by activating pneumatic cylinders 323 and 325. Gripper pneumatic cylinders 348 and arm-clamp pneumatic cylinder 330 are activated to open grippers 346 and arm clamp 334, releasing the coiled wire, which is now held on pallet 400. The pick and place head is then moved back toward Station A to repeat the process with the next selected wire that is being coiled on coiling spindle 242.

In the event that a splice is detected in wire being pulled through sensor assembly 88 as described above, control 82 stops motor 244 from further rotating coiling spindle 242 after the splice is advanced to a point just beyond shear 154. Pick and place head 304 is then positioned above the coiling spindle and caused to grip the coiled wire as already explained. Shear 154 cuts the wire so that the pick and place head can pick up the coiled wire and carry it to Station D, where it is dropped into waste receptacle 64. Control 82 then repeats the coiling of a measured length of selected wire 114 to replace the length that was being coiled and had to be discarded. The same process is effected in the event that the selected wire on one of the reels 52 is used up prior to the required length being coiled. In this case, an alarm alerts the operator, indicating that the empty reel must be replaced.

Those of ordinary skill in the art will appreciate that, in many instances, electrical linear actuators may be used in place of the various pneumatic cylinders in the preferred embodiment disclosed above. Although hydraulic cylinders might also be used for this purpose, leaks in a hydraulic system could contaminate the wire with hydraulic fluid. It should also be apparent that solenoids could be used to replace indexing pneumatic cylinders 310 and other short stroke pneumatic cylinders used in this system. Further refinements and other modifications to the invention will be apparent within the scope of the claims that follow. Accordingly, it is not intended that the invention be in any way limited by the disclosure of the preferred embodiment, but instead, that it be determined entirely by reference to the claims.

The embodiments of the invention in which an exclusive property or privilege is claimed are defined as follows:

1. A system for automatically coiling, cutting, and handling one of a plurality of wires, comprising:

a. means for selecting one of the plurality of wires to be cut and coiled;

b. coiling means for forming the wire into at least one coiled loop, by winding the wire around a rotatable spindle;

c. means for sensing the length of the wire as it is wound around the spindle;

d. control means, connected to the means for sensing the length of the wire and to the coiling means, and operative to stop the coiling means when a predetermined length of the wire has been coiled;

e. cutting means, for cutting the wire after the predetermined length is coiled;

f. tying means, for securing the loops of the wire so that they do not uncoil; and g. pick and place means for:

i. removing the loops of the coiled and cut wire from the spindle;

ii. moving the coiled wire to the tying means; and iii. moving the wire, after the loops are secured by the tying means, to a receiving station.

2. The system of claim 1, wherein the means for selecting include a movable frame in which the plurality of wires are spaced apart from each other in an array and in which means are provided for holding each wire in place until it is selected and advanced toward the coiling means.

3. The system of claim 1, wherein the spindle includes a plurality of segments pivotally mounted on the coiling means at spaced-apart points around a rotational center of the spindle to define a surface around which the wire is wound, said coiling means further including means for varying the diameter of the coiled loops of the wire by pivoting the segments into one of a plurality of different positions.

4. The system of claim 1, wherein the coiling means include a clamp for grasping an end of the wire as the spindle rotates.

5. The system of claim 1, wherein the means for sensing the length of the wire comprise means for detecting a pinch mark, where an insulating material covering the wire was pinched to mark a predetermined length, said pinch mark at least partially perforating the insulating material.

6. The system of claim 5, wherein the means for detecting a pinched mark on the wire comprise a capacitance sensor that contacts the wire and detects a difference in capacitance of the wire where the pinch mark in the insulating material at least partially perforates the insulating material.

7. The system of claim 1, wherein the means for sensing the length comprise a rotatable wheel that is in contact with the wire, and is caused to rotate as the wire is advanced and coiled by the coiling means, rotation of the wheel being operative to produce a signal indicative of the length of the wire advanced and coiled, which is input to the control means.

8. The system of claim 1, further comprising means for sensing a splice, said control means being connected to the means for sensing a splice and further operative to reject a length of wire in which a splice is sensed, rejection of the wire by the control means causing the pick and place means to discard the wire.

9. The system of claim 1, wherein the coiled loops of wire are secured with a strip of material that is wrapped around the coiled loops, through their center.

10. The system of claim 1, wherein the pick and place means include a plurality of pairs of opposed clamping fingers, spaced apart and radially distending around a central hub, said hub being movable in at least two orthogonal directions.

11. The system of claim 10, wherein the hub is connected to a frame that is movable between the coiling means, the tying means, and the receiving station.

12. The system of claim 11, wherein the pick and place means include a clamp disposed on an arm that is attached to the frame, said clamp being operative to grasp the wire when the coiled loops are removed from the spindle, moved to the tying means, and to the receiving station.

13. The system of claim 12, wherein the pick and place means further include means for sensing the rotational position of the spindle on the coiling means, which are connected to the control means, said control means being further operative after the wire is coiled to align the fingers of the pick and place means with gaps formed in the spindle to facilitate removal of the coiled loops.

14. The system of claim 13, wherein the control means incrementally rotate the pick and place means to align the fingers with the gaps.

15. The system of claim 1, wherein the receiving station includes a pallet on which coiled loops of wire that are to be connected in a common bundle are placed.

16. The system of claim 15, wherein the pallet includes means for clamping a free end of the coiled loops of wire as the pick and place means moves the coiled wire onto the pallet.

17. The system of claim 1, further comprising means for labeling the wire.

18. The system of claim 17, wherein the pick and place means further include means for determining locations of the tying means and the receiving station, thereby enabling the pick and place means to be properly positioned at these locations.

19. The system of claim 17, wherein the receiving station comprises a conveyor on which the coiled and secured loops are moved as distinct groups of related wires.

20. A system for automatically coiling, tying, and collecting in a related group, predetermined lengths of a plurality of wires of various types and gauges, comprising:

a. a plurality of reels on which the plurality of wires are each supplied, each reel being rotatably mounted, permitting the plurality of wires to be unwound from the reels;

b. a wire select station into which one end of each of the plurality of wires extends and is held in place until selected for coiling, including means for selecting one of the plurality of wires and means for advancing the selected wire from its reel;

c. a coiling station disposed adjacent the wire select station, said coiling station including a rotatable central hub and having a clamp that engages the selected wire as it is wound into a coil around the hub;

d. means for measuring the length of the selected wire as it is advanced through the wire select station and coiled on the hub, including means for sensing when a predetermined length of the selected wire has been coiled;

e. a tie station, including tying means for wrapping a tie around the wire coil and securing it to prevent the wire from uncoiling;

f. a wire cutter, disposed between the wire select station and the coiling station and operative to cut the selected wire to the predetermined length;

g. pick and place means for moving the wire coil from the coiling station to the tie station after the selected wire is cut to its predetermined length, and from the tie station to a receiving station after the wire coil is secured with a wire tie; and h. control means for determining the selected wire, and for controlling the pick and place means, the wire select station, the coiling station, and the tie station according to a predefined sequential operation.

21. The system of claim 20, further including means for gripping the selected wire and transferring it to the coiling station.

22. The system of claim 20, wherein the wire select station includes a holding clamp associated with each wire, for engaging the end of each wire until it is selected and advanced, said means for selecting comprising a pair of plates that are movable toward and away from each other, said plates being moved apart during selection of one of the plurality of wires, so that the wires can be moved between the plates.

23. The system of claim 22, wherein the pair of plates include a plurality of rotatable wheels that engage the selected wire when the plates are moved toward each other, said plurality of wheels serving to guide the wire as it unwinds from the reel, the wheels comprising the means for measuring the length of the selected wire.

24. The system of claim 22, wherein the selected wire includes a plurality of pinch marks at least partially perforating its insulation, which are spaced apart at predetermined lengths along the selected wire, the means for sensing the predetermined length being disposed on the pair of plates and comprising a capacitance sensor that monitors the capacitance of the wire and detects the pinch mark by the change of capacitance at a specific point along the wire resulting from the at least partial perforation of the insulation at the pinch mark.

25. The system of claim 20, wherein the hub of the coiling station has a selectively variable diameter, said control means being operative to select a diameter for the hub as a function of the predetermined length of the selected wire.

26. The system of claim 25, wherein the hub includes a plurality of pivotally mounted segments that define its diameter depending on the pivotal disposition of the segments.

27. The system of claim 26, wherein the segments are spaced apart from each other, leaving gaps between adjacent segments, said pick and place means including a plurality of opposed fingers that extend into said gaps and engage the wire coil to remove it from the hub.

28. The system of claim 27, wherein the coil station further includes means for producing a signal indicating the rotational position of the hub, and wherein the control means are further operative to position opposed fingers in alignment with the gaps by rotating the pick and place means in response to said signal.

29. The system of claim 20, wherein the pick and place means comprise an arm connected to a frame and wherein the arm and frame are movable both separately and together, enabling an end of the arm to move in at least two dimensions.

30. The system of claim 29, wherein the pick and place means include a clamp pivotally connected to the frame, said clamp being operative to engage an end of the selected wire and pivot with it to maintain tension in the selected wire after it is cut.

31. The system of claim 20, wherein the tying means include a plurality of positions for tying wire coils of varying cross section.

32. The system of claim 20, wherein the wire select station includes means for detecting a splice, said control means being operative to cause the pick and place means to move a wire coil in which a splice has been detected to a discard pile.

33. The system of claim 32, wherein the control means are also operative to cause the pick and place means to discard a coiled length of wire that is shorter than a desired predetermined length.

34. The system of claim 20, wherein the control means are further operative to group related tied wire coils at the receiving station.

35. The system of claim 20, wherein the receiving station comprises a conveyor on which the tied wire coils are transported.

* * * * *